US008088471B2

(12) United States Patent
Spitzer et al.

(10) Patent No.: US 8,088,471 B2
(45) Date of Patent: Jan. 3, 2012

(54) PAPER PRODUCT WITH ENHANCED EMBOSS AND BACKGROUND PATTERN CONTRAST

(75) Inventors: Rebecca Howland Spitzer, Springfield Township, OH (US); Ward William Ostendorf, West Chester, OH (US); Elizabeth Jan Mercer, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 828 days.

(21) Appl. No.: 12/130,137

(22) Filed: May 30, 2008

(65) Prior Publication Data

US 2009/0297775 A1 Dec. 3, 2009

(51) Int. Cl.
*B32B 3/00* (2006.01)
*B31F 1/12* (2006.01)
*D06N 7/04* (2006.01)

(52) U.S. Cl. ..... 428/156; 428/153; 428/172

(58) Field of Classification Search ..... 428/153, 428/154, 156, 172; 162/109, 111, 113
See application file for complete search history.

(56) References Cited

U.S. PATENT DOCUMENTS

| | | | | |
|---|---|---|---|---|
| 4,894,726 | A | 1/1990 | Steinhardt et al. | |
| 5,179,448 | A | 1/1993 | Steinhardt et al. | |
| D405,270 | S | 2/1999 | Horner-Long et al. | |
| D405,271 | S | 2/1999 | Unwin et al. | |
| D422,150 | S | 4/2000 | Enderby | |
| D426,709 | S | 6/2000 | Latchoo et al. | |
| 6,261,666 | B1 * | 7/2001 | Enderby et al. | 428/172 |
| 6,348,131 | B1 | 2/2002 | Kershaw et al. | |
| D462,180 | S | 9/2002 | Kao et al. | |
| 6,602,577 | B1 | 8/2003 | Ostendorf et al. | |
| D520,249 | S | 5/2006 | Hasenoehrl | |
| D520,754 | S | 5/2006 | Hasenoehrl | |
| 7,169,458 | B2 | 1/2007 | Underhill et al. | |
| 7,311,800 | B2 | 12/2007 | Russell et al. | |
| 7,326,322 | B2 | 2/2008 | Ruthven et al. | |

OTHER PUBLICATIONS

Beyer, J., *Designing Tessellations: The Secrets of Interlocking Patterns*, pp. 10-30 (Contemporary Books, Chicago, IL 1999).

* cited by examiner

*Primary Examiner* — Catherine A Simone
(74) *Attorney, Agent, or Firm* — Christian M. Best

(57) ABSTRACT

A ply of fibrous structure product comprises a background pattern and a repeating pattern disposed on a portion of the background pattern. The repeating pattern comprises a master pattern comprising a first individual embossment comprising a major axis and a minor axis, a first line segment axis parallel to the major axis of the first individual embossment, and at least one individual embossment adjacent to the first individual embossment The individual embossment adjacent to the first individual embossment comprises a major axis and a minor axis. The major axis of the individual embossment adjacent to the first individual embossment and the first line segment axis form an angle of from about 0.5° to about 20°.

20 Claims, 19 Drawing Sheets

PAPER PRODUCT WITH ENHANCED EMBOSS AND BACKGROUND PATTERN CONTRAST

FIELD OF THE INVENTION

The present invention relates to fibrous structure products, more specifically embossed multi-ply fibrous structure products having an enhanced multiple-pattern appearance.

BACKGROUND OF THE INVENTION

Cellulosic fibrous structures are a staple of everyday life. Cellulosic fibrous structures are used as consumer products for paper towels, toilet tissue, facial tissue, napkins, and the like. The large demand for such paper products has created a demand for improved versions of the products and the methods of their manufacture.

Some consumers prefer embossed cellulosic fibrous structure products that have a softer, more three-dimensional, quilted appearance. Consumers also desire products having the appearance of relatively high caliper with aesthetically pleasing decorative patterns exhibiting a high quality cloth-like appearance. Such attributes, however, must be provided without sacrificing the other desired functional qualities of the product such as softness, absorbency, drape (flexibility/limpness) and bond strength between the plies.

In addition to providing a quilted appearance, multiple emboss patterns may be used to provide additional aesthetic and/or functional benefits to the consumer. For example, some cellulosic fibrous structure products utilize an emboss pattern over a textured or otherwise patterned background. In some cases the background pattern may distract from, camouflage, mask, distort, hide or otherwise interfere with, the emboss pattern, causing the final product to be aesthetically unacceptable to the consumer. Therefore, certain features are important to incorporate into the pattern on the substrate to enhance the visualization of all patterns and prevent pattern distortion or interference problems. Exemplary features may include pattern frequency, size, shape, alignment and the like.

The present invention unexpectedly provides a fibrous structure product with an aesthetically pleasing emboss pattern that provides enhanced emboss appearance through optimization of emboss and background patterns while maintaining important product attributes such as absorbency, strength, and/or softness.

SUMMARY OF THE INVENTION

In one embodiment, the present invention is directed to a ply of cellulosic fibrous structure product comprising:

a repeating pattern;

wherein the repeating pattern comprises a master pattern, wherein the master pattern comprises:

a first individual embossment, wherein the first individual embossment comprises a major axis and a minor axis;

a first line segment axis parallel to the major axis of the first individual embossment;

at least one individual embossment adjacent to the first individual embossment, wherein the individual embossment adjacent to the first individual embossment comprises a major axis and a minor axis such that the major axis of the individual embossment adjacent to the first individual embossment and the first line segment axis form an angle of from about 0° to about 20°;

a second individual embossment, wherein the second individual embossment comprises a major axis and a minor axis;

a second line segment axis parallel to the major axis of the second individual embossment;

at least one individual embossment adjacent to the second individual embossment, wherein the individual embossment adjacent to the second individual embossment comprises a major axis and a minor axis such that the major axis of the individual embossment adjacent to the second individual embossment and the second line segment axis form an angle of from about 0° to about 20°;

wherein the first line segment axis and the second line segment axis intersect;

a background pattern;

wherein the background pattern comprises one or more features forming a base pattern;

wherein the repeat frequency by which the base pattern is repeated within a certain area is greater than about 1.5 times by which a master pattern is repeated within the same area.

In one embodiment, the present invention is directed to a ply of cellulosic fibrous structure product comprising:

a repeating pattern;

wherein the repeating pattern comprises a master pattern, wherein the master pattern comprises:

a first individual embossment, wherein the first individual embossment comprises a major axis and a minor axis;

a first line segment axis parallel to the major axis of the first individual embossment;

at least one individual embossment adjacent to the first individual embossment, wherein the individual embossment adjacent to the first individual embossment comprises a major axis and a minor axis such that the major axis of the individual embossment adjacent to the first individual embossment and the first line segment axis form an angle of from about 0° to about 20°;

a second individual embossment, wherein the second individual embossment comprises a major axis and a minor axis;

a second line segment axis parallel to the major axis of the second individual embossment;

at least one individual embossment adjacent to the second individual embossment, wherein the individual embossment adjacent to the second individual embossment comprises a major axis and a minor axis such that the major axis of the individual embossment adjacent to the second individual embossment and the second line segment axis form an angle of from about 00 to about 20°;

wherein the first line segment axis and the second line segment axis intersect;

a background pattern comprising one or more identical features.

DETAILED DESCRIPTION OF THE INVENTION

Figure 1A:
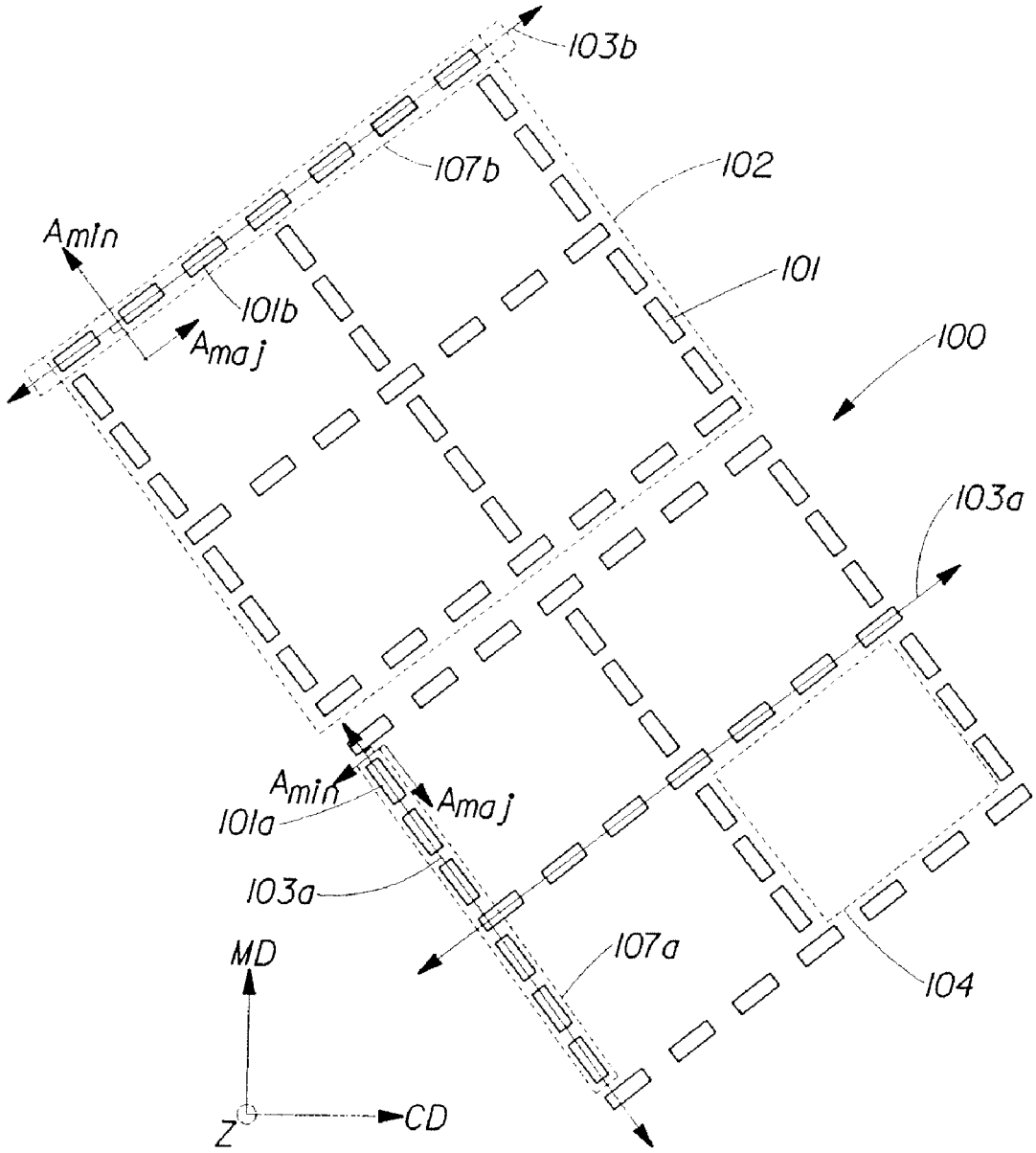
FIG. 1A is a top view of an exemplary embodiment of a cellulosic fibrous structure product according to the present invention.

"Paper product", as used herein, refers to any formed fibrous structure product, which may, but not necessarily, comprise cellulose fibers. In one embodiment, the paper products of the present invention include tissue-towel paper products.

"Tissue-towel paper product", as used herein, refers to products comprising paper tissue or paper towel technology in general, including, but not limited to, conventional felt-pressed or conventional wet-pressed tissue paper, pattern densified tissue paper, starch substrates, and high bulk, uncompacted tissue paper. Non-limiting examples of tissue-towel paper products include toweling, facial tissue, bath tissue, table napkins, and the like.

"Ply" or "Plies", as used herein, means an individual fibrous structure or sheet of fibrous structure, optionally to be disposed in a substantially contiguous, face-to-face relationship with other plies, forming a multi-ply fibrous structure. It is also contemplated that a single fibrous structure can effectively form two "plies" or multiple "plies", for example, by being folded on itself. In one embodiment, the ply has an end use as a tissue-towel paper product. A ply may comprise one or more wet-laid layers, air-laid layers, and/or combinations thereof. If more than one layer is used, it is not necessary for each layer to be made from the same fibrous structure. Further, the fibers may or may not be homogenous within a layer. The actual makeup of a tissue paper ply is generally determined by the desired benefits of the final tissue-towel paper product, as would be known to one of skill in the art. The fibrous structure may comprise one or more plies of non-woven materials in addition to the wet-laid and/or air-laid plies.

"Fibrous structure", as used herein, means an arrangement of fibers produced in any papermaking machine known in the art to create a ply of paper. "Fiber" means an elongate particulate having an apparent length greatly exceeding its apparent width. More specifically, and as used herein, fiber refers to such fibers suitable for a papermaking process.

"Basis Weight", as used herein, is the weight per unit area of a sample reported in lbs/3000 $ft^2$ or $g/m^2$.

"Machine Direction" or "MD", as used herein, means the direction parallel to the flow of the fibrous structure through the papermaking machine and/or product manufacturing equipment.

"Cross Machine Direction" or "CD", as used herein, means the direction perpendicular to the machine direction in the same plane of the fibrous structure and/or fibrous structure product comprising the fibrous structure.

"Z-direction", as used herein, means the direction normal to a plane formed by machine direction and cross machine directions.

"Embossing" or "embossments", as used herein, refers to the process of deflecting a portion (e.g. a relatively small portion), of a cellulosic fibrous structure normal to its plane and impacting the projected portion of the fibrous structure against another surface, e.g. a relatively rigid surface, to permanently disrupt the fiber-to-fiber bonds. "Discrete", when referring to embossing, means that adjacent embossed sites are not contiguous. Exemplary methods of, and apparatus for, embossing are described in U.S. Pat. Pub. No. 2007/0062658A1 and U.S. Pat. Nos. 3,414,459, 4,320,162 and 5,468,323.

"Repeating", as used herein, means a pattern is formed more than once.

"Essentially continuous", as used herein, refers to a region extending substantially throughout the fibrous structure in one or both of its principal directions.

"Repeating pattern", as used herein, means a design comprising a plurality of one or more master patterns. The master pattern may be asymmetrical or symmetrical and may be repeated to form the repeating pattern. In some embodiments, a master pattern is the smallest multi-element (i.e., having more than one element, feature, embossment, and the like) portion of the repeating pattern that may be used to provide the remaining elements of the repeating pattern via translation transformations. For example, a single element, feature, or embossment that recurs over a surface is not a repeating pattern as is used in the present invention. In one embodiment, a master pattern has an area of from about 0.5 $in^2$ to about 121 $in^2$. In another embodiment, a master pattern has an area of from about 0.6 $in^2$ to about 60 $in^2$. In another embodiment, a master pattern has an area of from about 0.8 $in^2$ to about 8 $in^2$.

"Line axis pattern", as used herein, means a plurality of adjacent elements, features, or embossments that share a common line segment axis. In one embodiment, a line axis pattern connects three or more adjacent embossments and the line segment axis is parallel to, or collinear with, the major axis of each element, feature or embossment. In another embodiment, a master pattern does not comprise a line segment axis in which the major axes of at least three adjacent elements, features, or embossments, are not collinear. Put another way, in one embodiment, a master pattern comprises a plurality of line segment axes between three or more adjacent elements, features, or embossments. The master pattern does not comprise any line segment axes wherein three or more adjacent elements, features, or embossments do not have major axes which are collinear.

"Cell", as used herein, is a unit of a two- or three dimensional array comprising a group of unembossed individual enclosures surrounded by a discrete, repeating, individual embossments. In one embodiment, a cell has an area of from about 0.0625 $in^2$ to about 100 $in^2$. In another embodiment, a cell has an area of from about 0.07 $in^2$ to about 70 $in^2$. In another embodiment, a cell has an area of from about 0.08 $in^2$ to about 8 $in^2$. In another embodiment, a cell has an area of from about 0.09 $in^2$ to about 3 $in^2$. Surface area, as described herein, includes the entire area which is enclosed by a feature.

"Deformation", as used herein, refers to out of plane deflection of the fibrous structure product that is formed by embossments, that is formed during the papermaking process by, for example, deflection of the wet web into a paper making belt, or other processes of deflecting the fibrous structure product, either wet or dry, out of plane, and combinations thereof. Deformation, as used herein, may or may not permanently disrupt the fiber to fiber bonds.

"Laminating", as used herein, refers to the process of firmly uniting superimposed layers of paper with or without adhesive, to form a multi-ply sheet.

"Non-naturally occurring fiber", as used herein, means that the fiber is not found in nature in that form. In other words, some chemical processing of materials needs to occur in order to obtain the non-naturally occurring fiber. For example, a wood pulp fiber is a naturally occurring fiber, however, if the wood pulp fiber is chemically processed, such as via a lyocell-type process, a solution of cellulose is formed. The solution of cellulose may then be spun into a fiber. Accordingly, this spun fiber would be considered to be a non-naturally occurring fiber since it is not directly obtainable from nature in its present form.

"Naturally occurring fiber", as used herein, means that a fiber and/or a material is found in nature in its present form. An example of a naturally occurring fiber is a wood pulp fiber.

"Background pattern", as used herein, means a pattern of features that substantially covers the surface of a fibrous structure product. One of skill in the art may appreciate that a background pattern may be distinguished from a repeating pattern because a repeating pattern may comprise a plurality of line segment patterns, line segment axes, and cells whereas, in some embodiments, a background pattern may only comprise a single feature which is repeated at any frequency and/or interval. In other embodiments, a background pattern comprises a plurality of features which may form a repeating unit. A repeating unit may be described as a design comprising a plurality of one or more base patterns. The base pattern may be asymmetrical or symmetrical and may be repeated to form the repeating unit. In some embodiments where the base pattern comprises more than one feature, the base pattern is the smallest multi-feature portion of the repeating pattern that may be used to provide the remaining elements of the repeating pattern via translation transformations. In some embodiments, a background pattern does not comprise a cell.

A background pattern may be formed using any means known in the art. For example, in some embodiments, a background pattern may be introduced into the surface of a fibrous structure product using embossing or micro-embossing. Exemplary embodiments of micro embossing are described in EP 1525977 and WO 2003/084768. In other embodiments, a background pattern may be introduced into the surface of the fibrous structure product during the papermaking process using a textured or patterned belt. Exemplary methods and apparatus for using and/or making a patterned belt are described in U.S. Pat. Nos. 3,301,746, 3,974,025, 4,191,609, 4,637,859, 3,301,746, 3,821,068, 3,974,025, 3,573,164, 3,473,576, 4,239,065, and 4,528,239.

Fibrous Structure Product

A nonlimiting example of a ply of an embossed fibrous structure product 100 in accordance with the present invention is shown in FIG. 1A. As shown in FIG. 1A a fragmentary plan view of a ply of an embossed fibrous structure product 100 comprising a ply of fibrous structure wherein the ply of the fibrous structure product comprises a plurality of individual embossments 101 forming one or more master patterns 102. In some embodiments, an individual embossment 101 may be interchangeably referred to as an individual element 101.

The individual embossments 101 comprise an aspect ratio. The aspect ratio of the individual embossments may be calculated by determining the length of the major axis $A_{maj}$ (FIG. 2) of an individual embossment. The major axis may be described as follows: A rectangle is drawn (in the plane formed by the MD and CD) around the embossment 101 such that a single side of the rectangle is tangent to the embossment 101 (i.e., intercepts no more than one point on the embossment 101). A line that is parallel to, or collinear with, the longest side of the rectangle is the major axis $A_{maj}$. The minor axis $A_{min}$ is a line that is perpendicular to, and coplanar with, the major axis. The aspect ratio is then calculated as:

$$\text{Aspect Ratio} = \frac{\text{major_axis_length_of_the_individual_embossment}}{\text{minor_axis_length_of_the_individual_embossment}}$$

In the exemplary embodiment, the individual embossments 101 are aligned as follows: A first individual embossment 110*a* is identified and a line segment axis 103*a* is identified such that the line segment axis 103 may be substantially parallel or collinear with the major axis of the first individual embossment 110*a*. Additional individual embossments 101 may be positioned such that the major axis of at least one adjacent individual embossment 101 is substantially parallel or collinear with the line segment axis 103*a* to form a line axis pattern 107*a*. A different first individual embossment 101*b* may be positioned such that the major axis of at least one adjacent individual embossment is substantially parallel or collinear with the line segment axis 103*b* to form a separate line axis pattern 107*b*. In some embodiments, at least two adjacent embossments 101 have major axes which are substantially parallel with the major axis of the first individual embossment 101*a*. The number of individual embossments in a line axis pattern 103*a* is not indefinite and may be finite. In other words, multiple line axis patterns may be used to form a master pattern 102. In some embodiments there are at least 3 adjacent individual embossments in a line axis pattern. In other embodiments there are from about 3 to about 10 individual embossments in a line axis pattern. In other embodiments still, there are from about 3 to about 6 individual embossments in a line axis pattern.

In one embodiment, the master pattern 102 forms an unembossed cells 104 within the master pattern 102. In some embodiments, the unembossed cells 104 may comprise from about 2% to about 98% of the area of the master pattern. In other embodiments, the unembossed cells 104 may comprise from about 5% to about 95% of the area of the master pattern. In other embodiments, the unembossed cells 104 may comprise from about 20% to about 30% of the area of the master pattern.

Figure 1B:
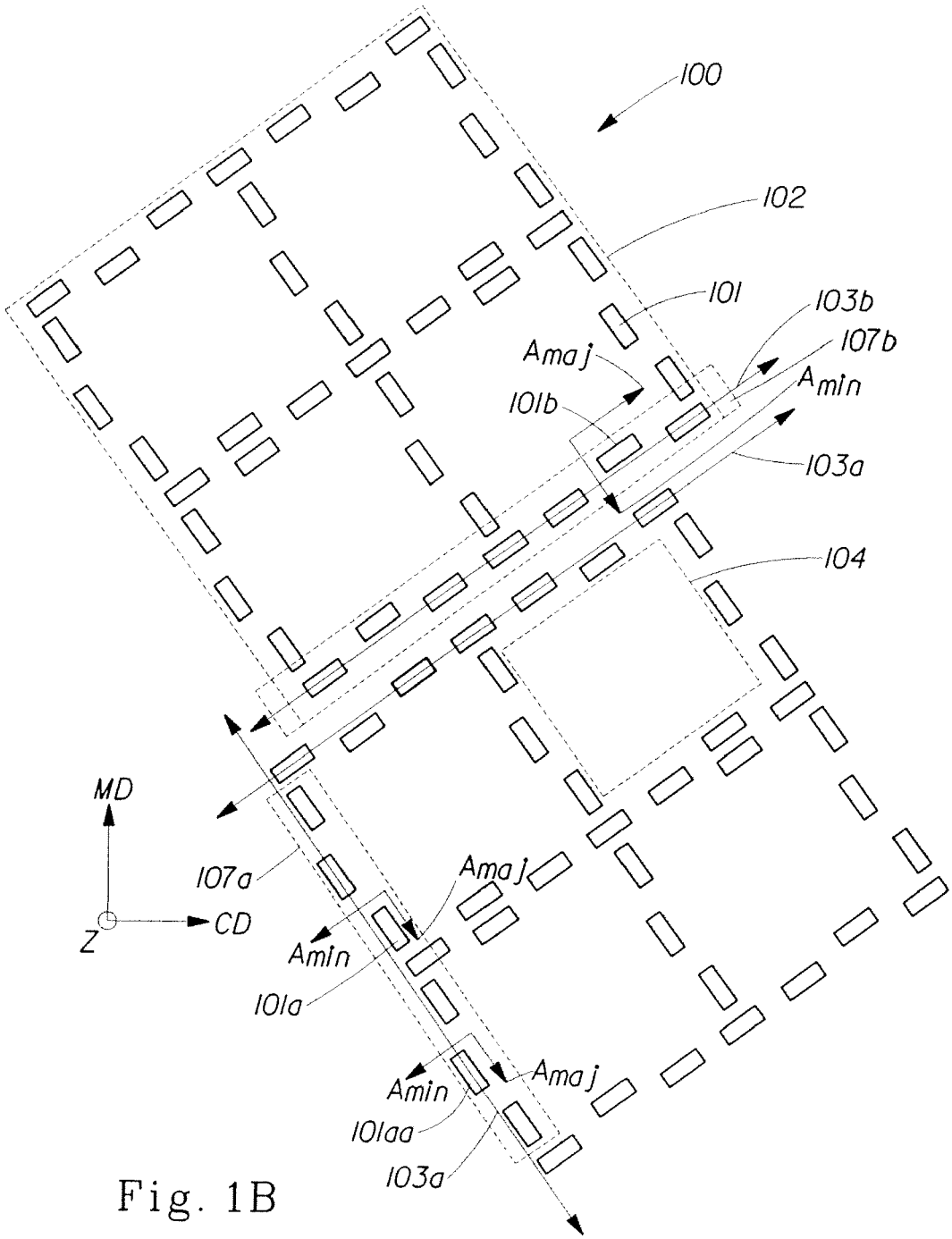
FIG. 1B is a top view of an exemplary embodiment of a cellulosic fibrous structure product according to the present invention.

An alternative embodiment of the embossed fibrous structure product 100 is shown in FIG. 1B. The first individual embossment 101*a* does not have to be collinear with a second individual embossment 101*aa*. However, the major axes of both embossments (110*a* and 101*aa*) are substantially parallel with the line segment axis 103*a*.

Figure 2:
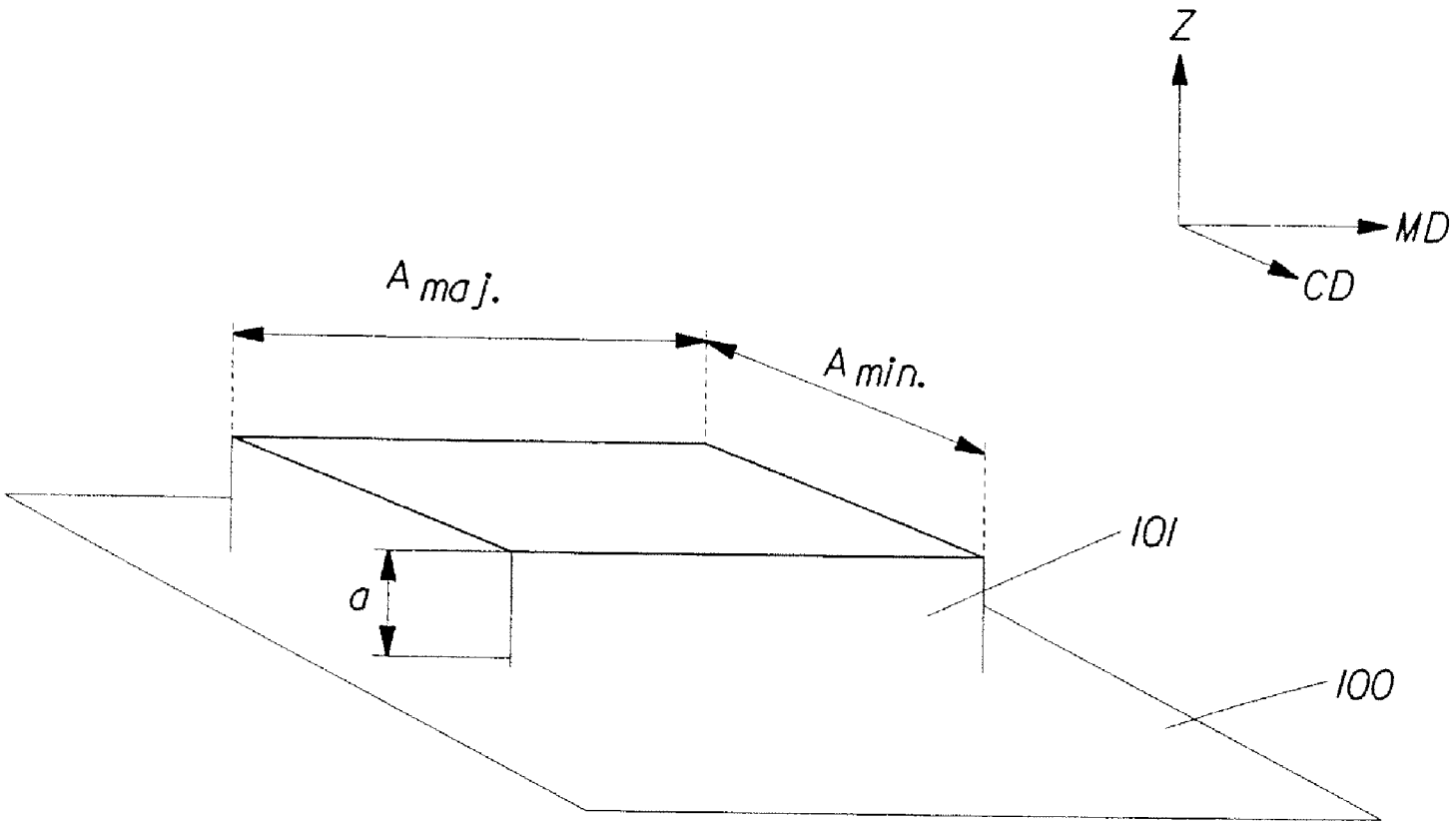
FIG. 2 is a plan view of an exemplary embodiment of an embossment according to the present invention.

An individual embossment 101 shown in FIGS. 1A and 1B is also shown in FIG. 2. The individual embossments 101 comprise a major axis $A_{maj}$ and a minor axis $A_{min}$, as shown in FIG. 2.

The aspect ratio of an individual embossment 101 is at least about 1.1. In another embodiment, the aspect ratio of an individual embossment 101 is at least about 1.2, in another embodiment the aspect ratio of an individual embossment 101 is from about 1.2 to about 6.0, and in another embodiment, the aspect ratio of an individual embossment 101 is from about 1.2 to about 5.0. In another embodiment still, the aspect ratio of an individual embossment 101 may be any ratio in between about 1.2 and about 3.0.

The individual embossment 101 may exhibit a height a that extends in the Z-direction which is perpendicular to the plane formed in the machine direction and the cross machine direction of the surface of the cellulosic fibrous structure product 100. In one embodiment of the present invention, the cellulosic fibrous structure product 100 comprises an individual embossment height a of from about 300 μm, about 600 μm, and/or about 700 μm to about 1,500 μm, and in another embodiment from about 800 μm or to about 1,000 μm as measured by the Embossment Height Measurement Method described herein. Exemplary apparatus and methods of embossing are disclosed in U.S. Pat. Nos. 3,323,983, 5,468,323, 5,693,406, 5,972,466, 6,030,690 and 6,086,715.

Figure 3:
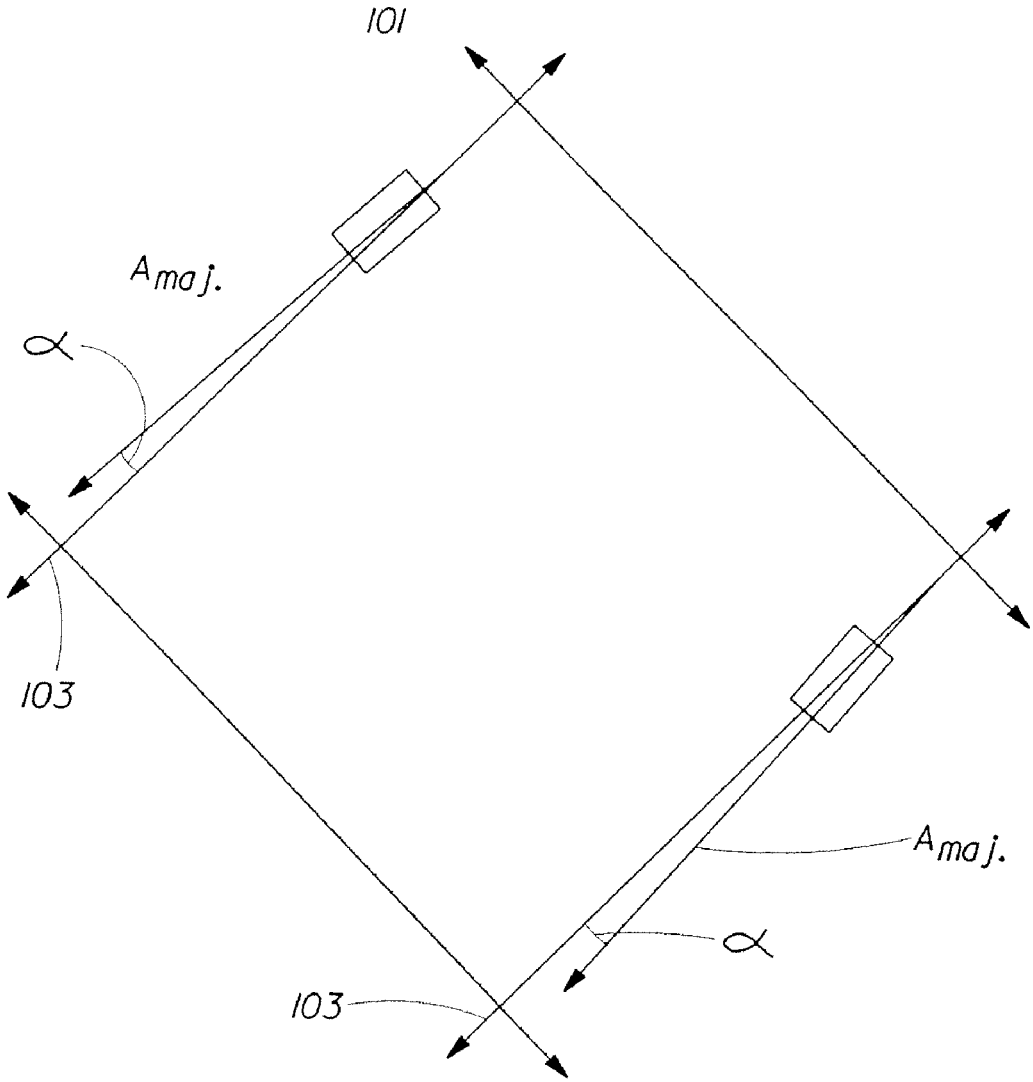
FIG. 3 is a top view of an exemplary embodiment of a master pattern according to the present invention.
Figure 4A:
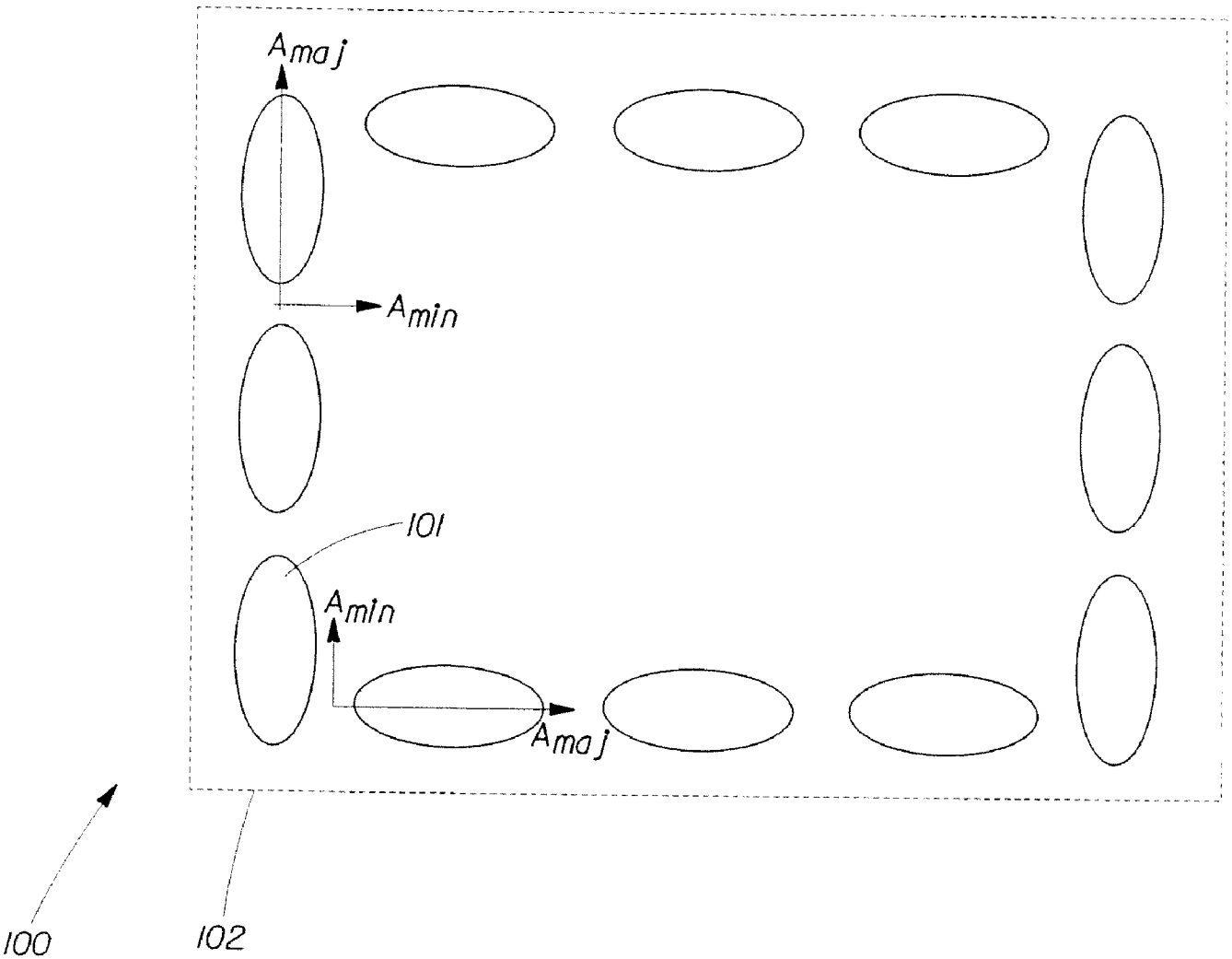
FIG. 4A is a top view of an exemplary embodiment of a master pattern according to the present invention.
Figure 4B:
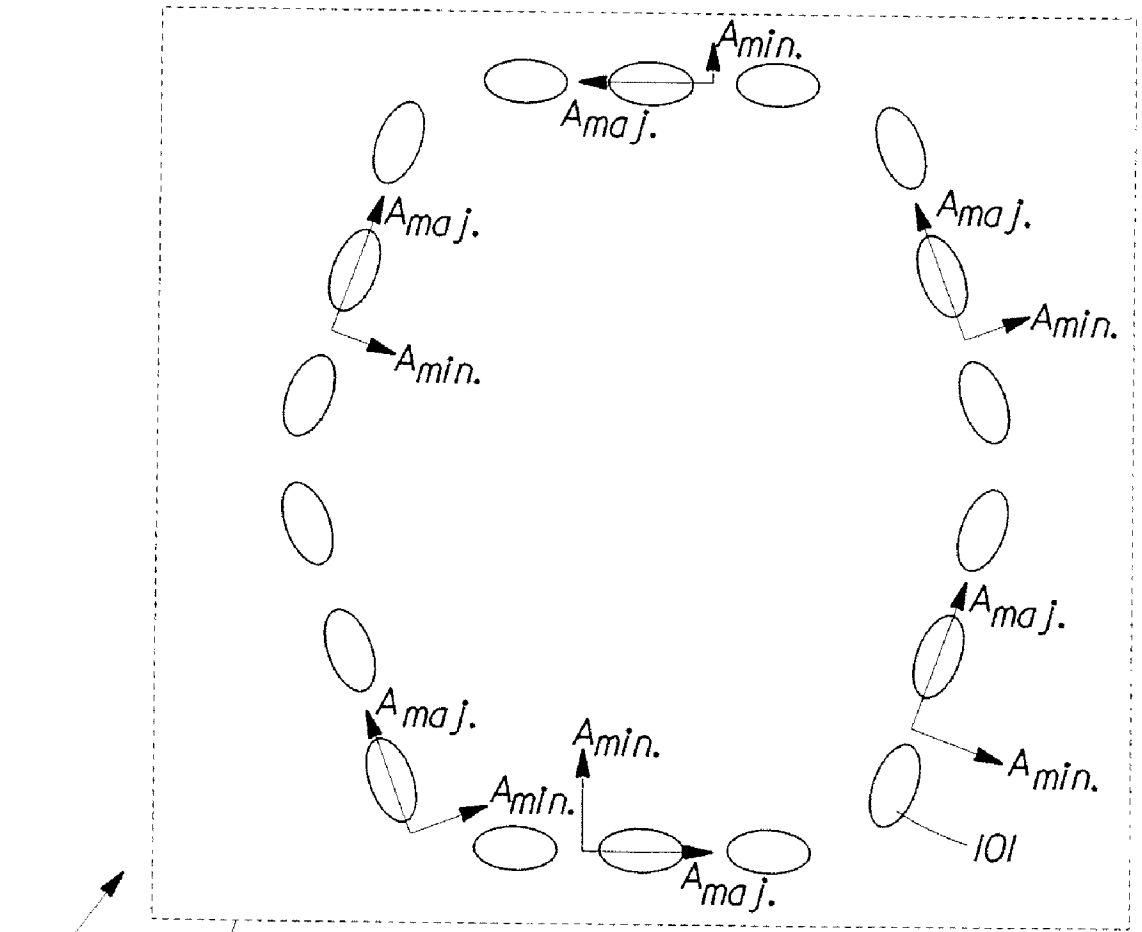
FIG. 4B is a top view of an exemplary embodiment of a master pattern according to the present invention.
Figure 4C:
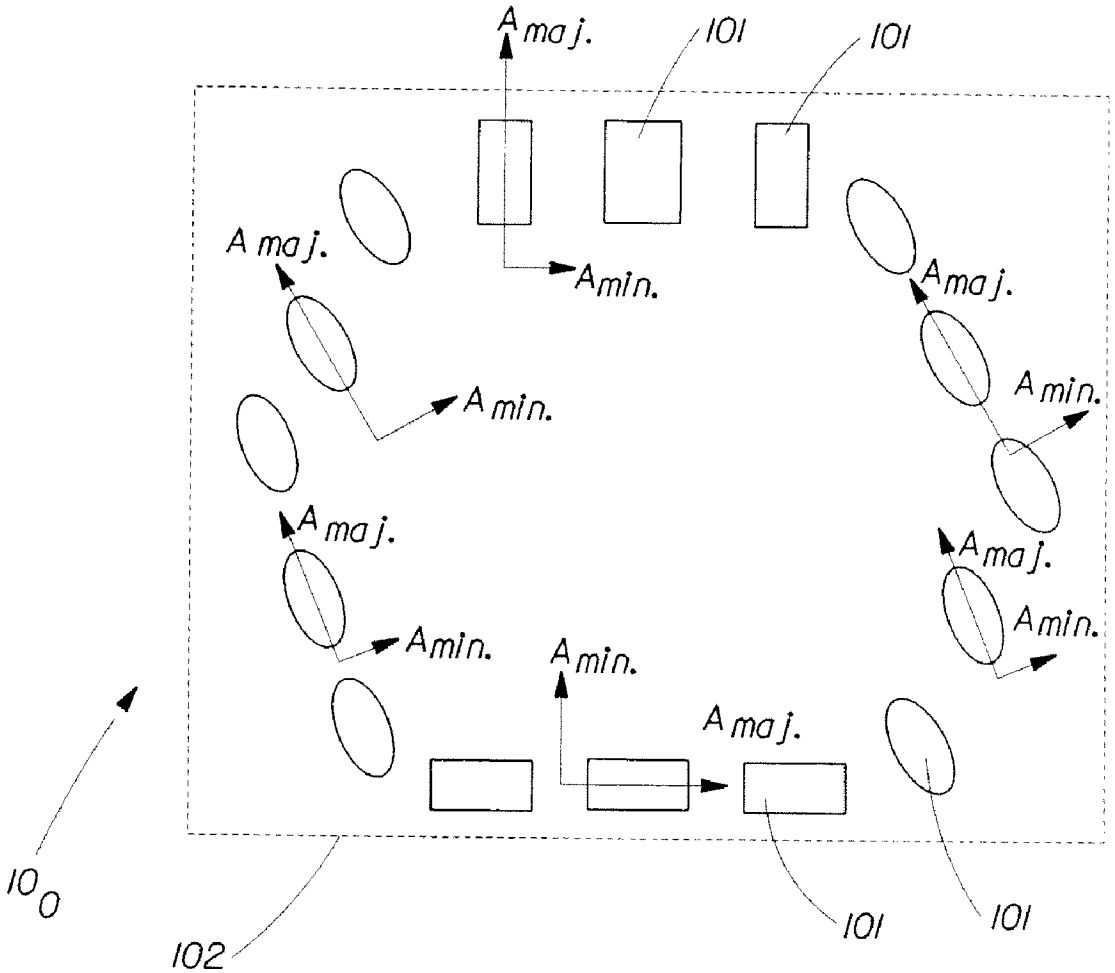
FIG. 4C is a top view of an exemplary embodiment of a master pattern according to the present invention.
Figure 4D:
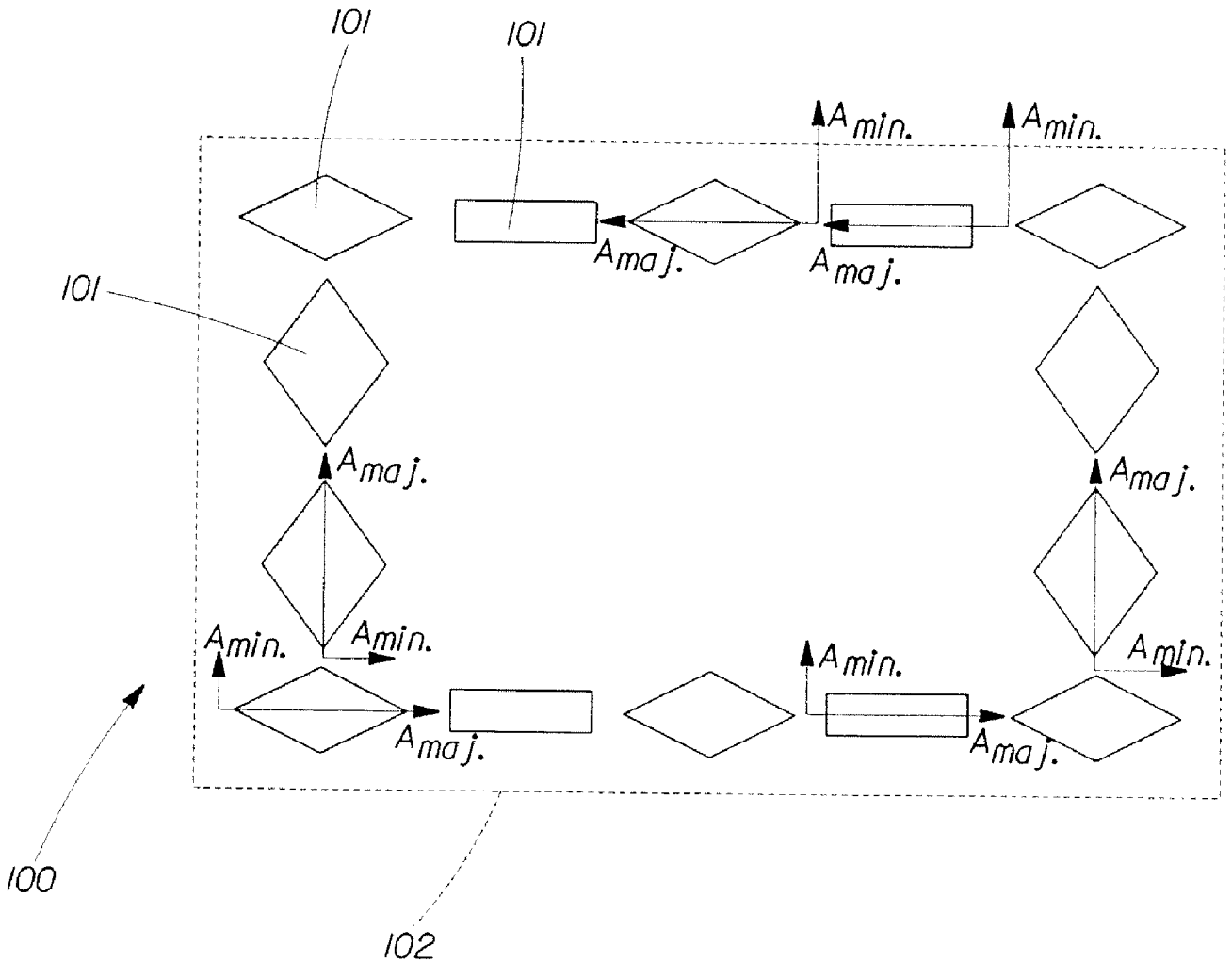
FIG. 4D is a top view of an exemplary embodiment of a master pattern according to the present invention.

As shown in FIG. 3 the individual embossments 101 comprise a major axis $A_{maj}$. A line segment axis 103 of the master pattern and the major axis $A_{maj}$ of the individual embossments 101 may form angle α wherein α is from about 0° to about 20°, in another embodiment α is from about 0.5° to about 10°. In another embodiment, α is from about 2.0° to about 5.0°. In another embodiment still, $A_{maj}$ and the line segment axis 103 are substantially parallel or collinear.

In another embodiment the line segment axis 103 of the master pattern 102 and the major axis $A_{maj}$ of the individual embossments 101 are adjacent to and substantially parallel to each other.

Repeating Patterns

As described supra, a repeating pattern comprises a plurality of master patterns 102. FIGS. 4A-4D describe exemplary embodiments cellulosic fibrous structure products 100 comprising individual embossments 101 that form master patterns 102 that may be used to form a repeating pattern. One of skill in the art may appreciate that multiple master patterns 102 may be used to provide a repeating pattern. In some embodiments, the individual embossments are the same size and/or shape. In other embodiments, the individual embossments are different shapes, sizes, proportions, and the like.

Background Pattern

FIGS. 5A-5D shows exemplary embodiments of background patterns which may be used in the fibrous structure product of the present invention. In the exemplary embodiments, the fibrous structure product 100 comprises a plurality of features 501 that substantially covers the surface of a fibrous structure product 100. One of skill in the art may appreciate that any the features of the background patterns may comprise any shape that may be suitable for the consumer. The shapes may be random, non-random, geometric, symmetrical, asymmetrical, and the like.

Figure 5A:
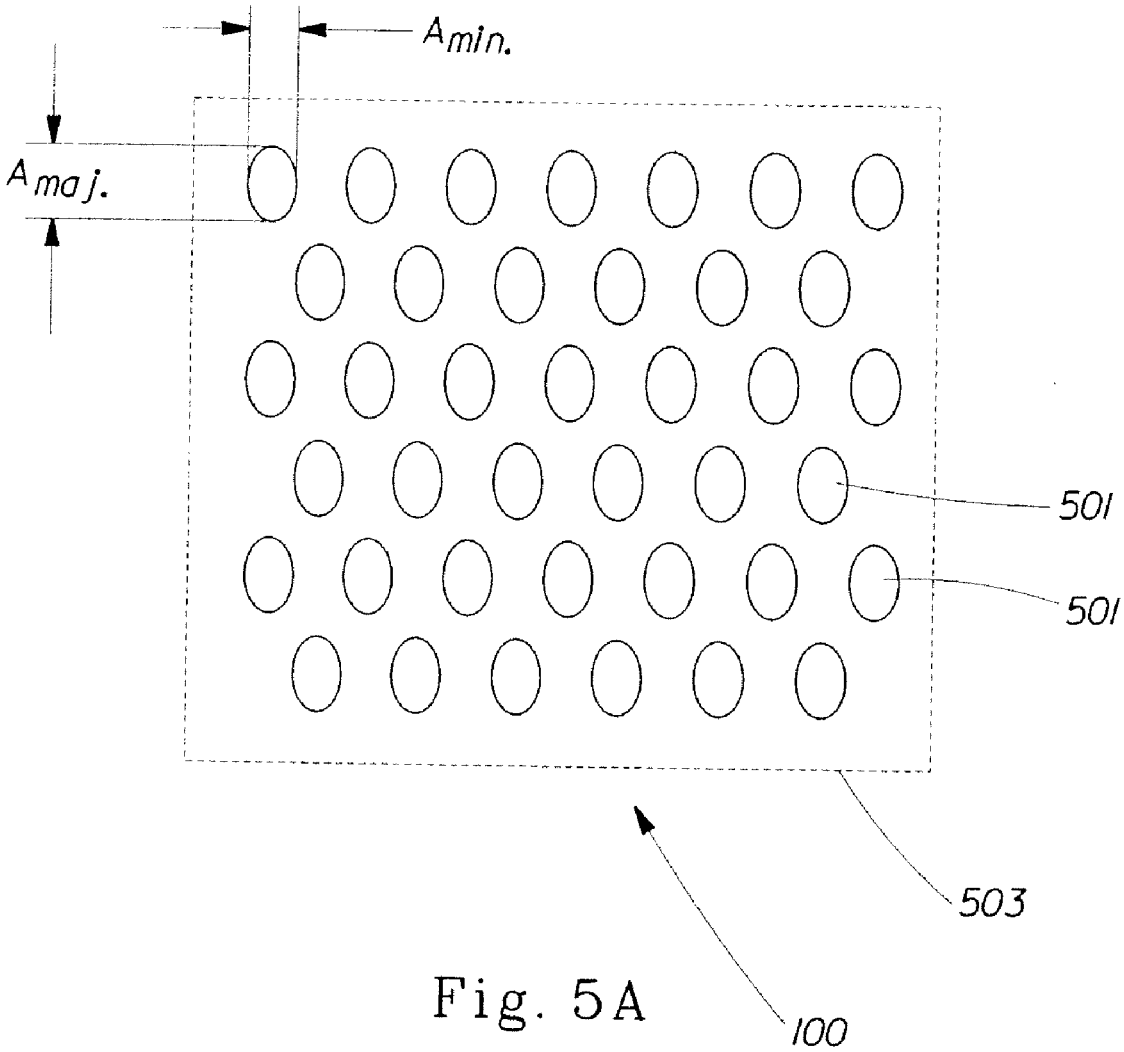
FIG. 5A is a top view of an exemplary embodiment of a fibrous structure product comprising a base pattern according to the present invention.
Figure 5B:
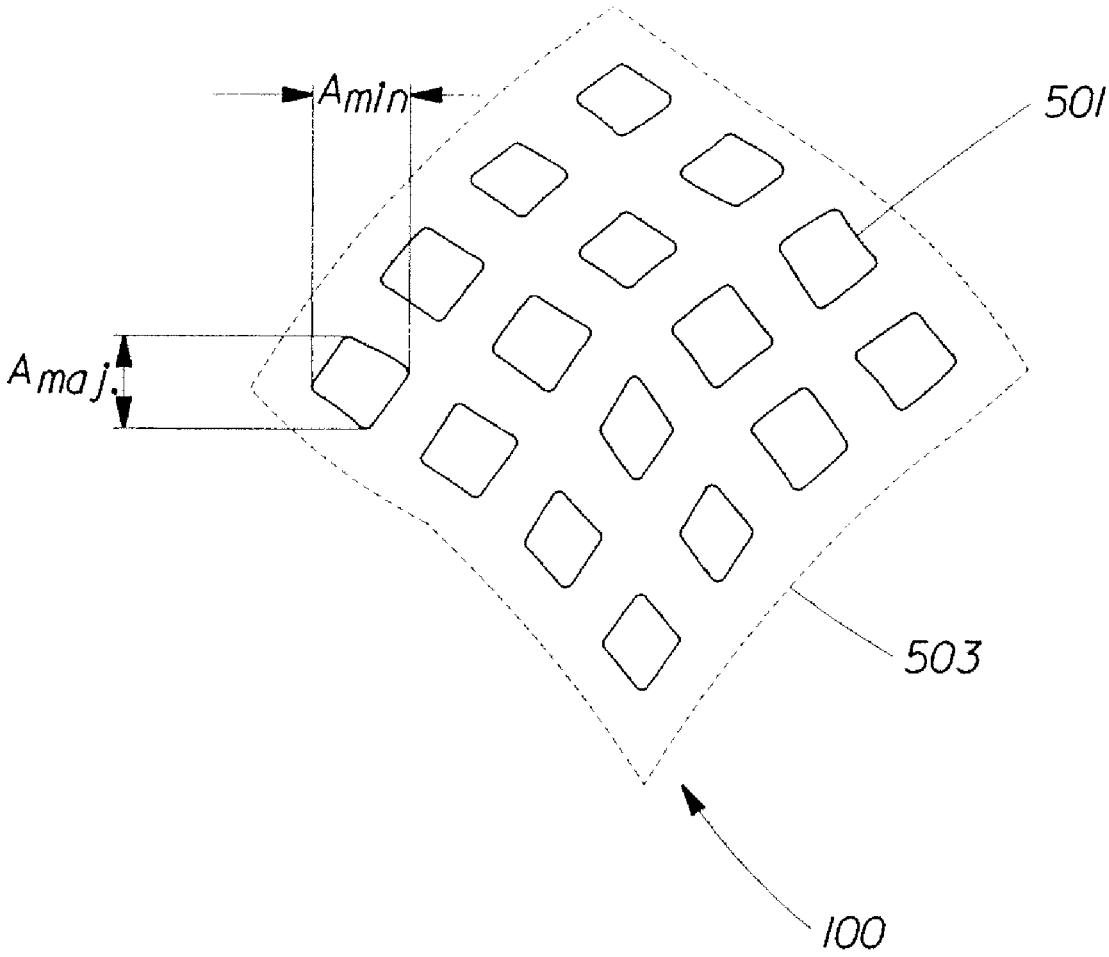
FIG. 5B is a top view of an exemplary embodiment of a fibrous structure product comprising a base pattern according to the present invention.
Figure 5C:
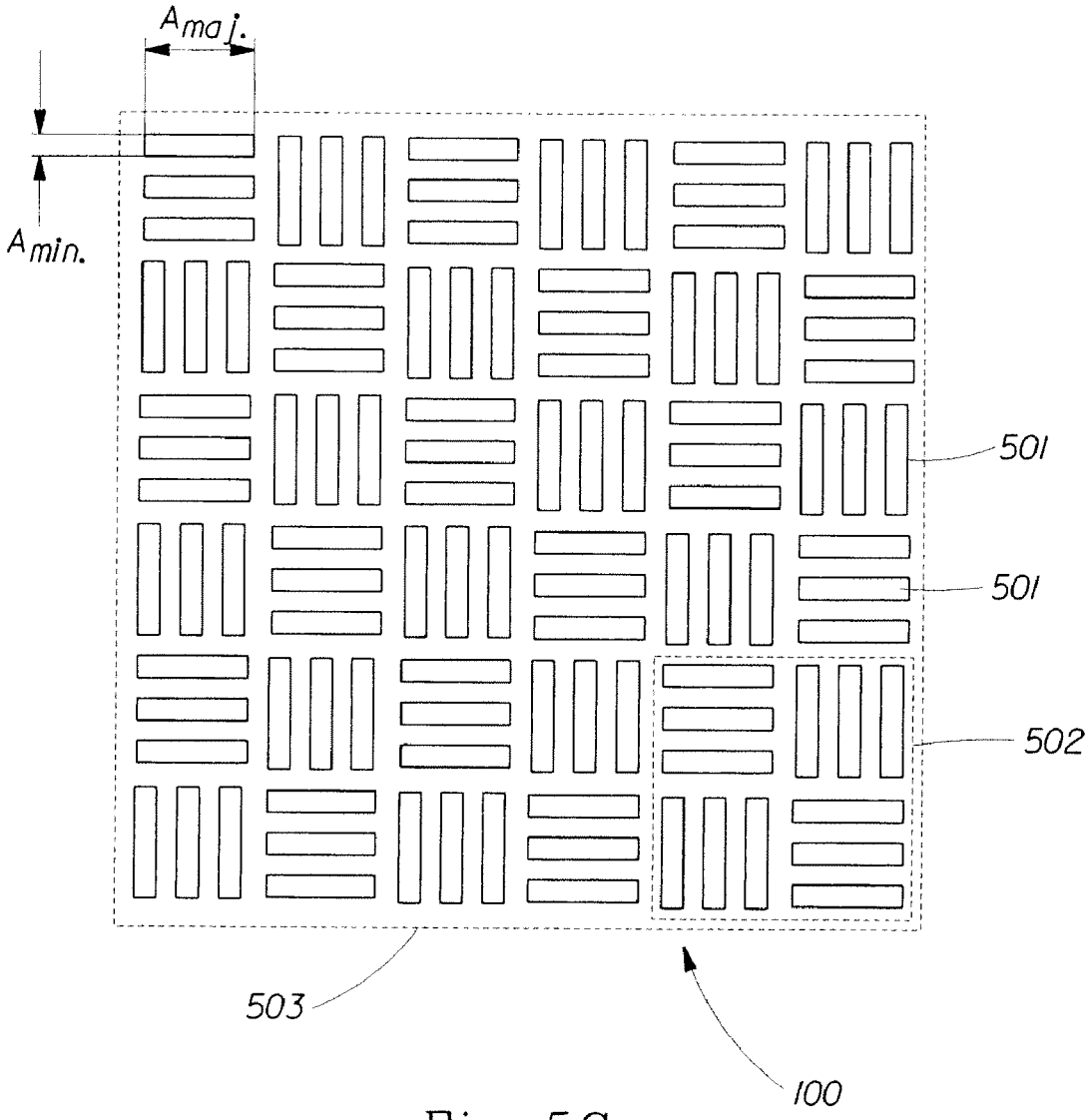
FIG. 5C is a top view of an exemplary embodiment of a fibrous structure product comprising a base pattern according to the present invention.
Figure 5D:
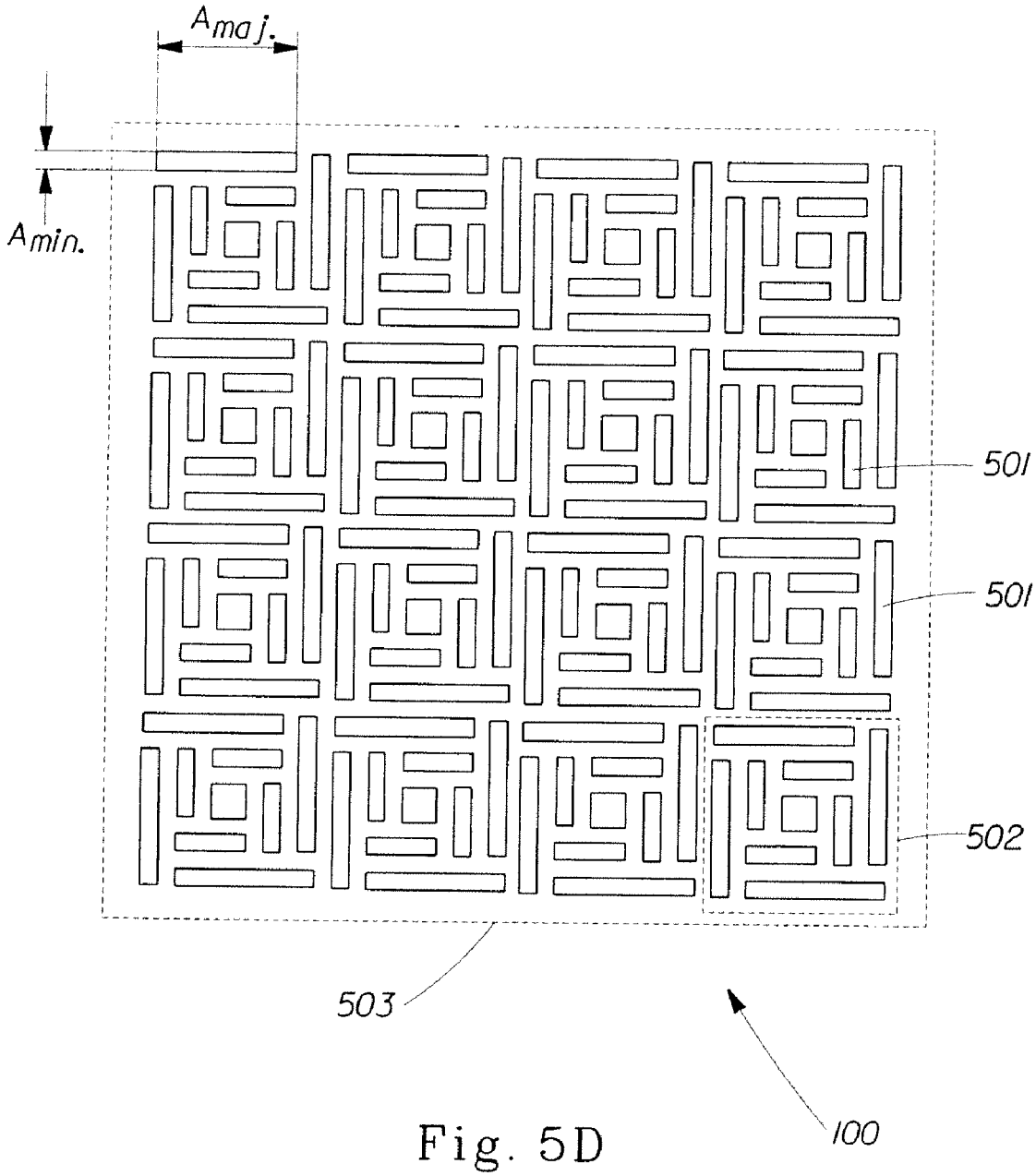
FIG. 5D is a top view of an exemplary embodiment of a fibrous structure product comprising a base pattern according to the present invention.
Figure 6A:
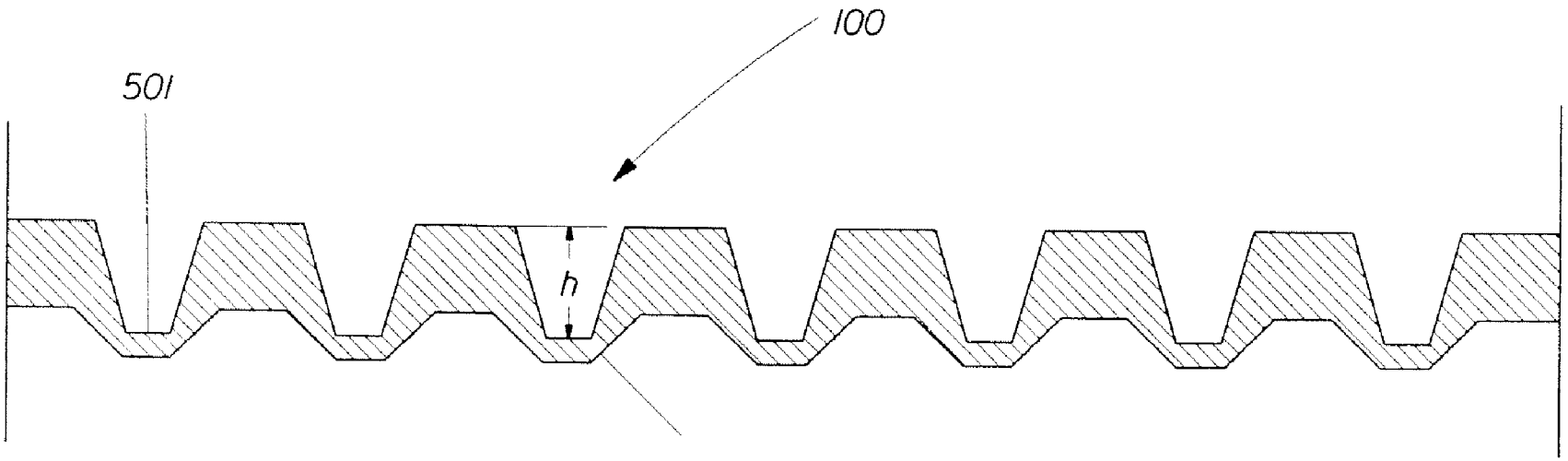
FIG. 6A is a cross-sectional view of the fibrous structure product of FIG. 5A taken along line 6A-6A.
Figure 6B:
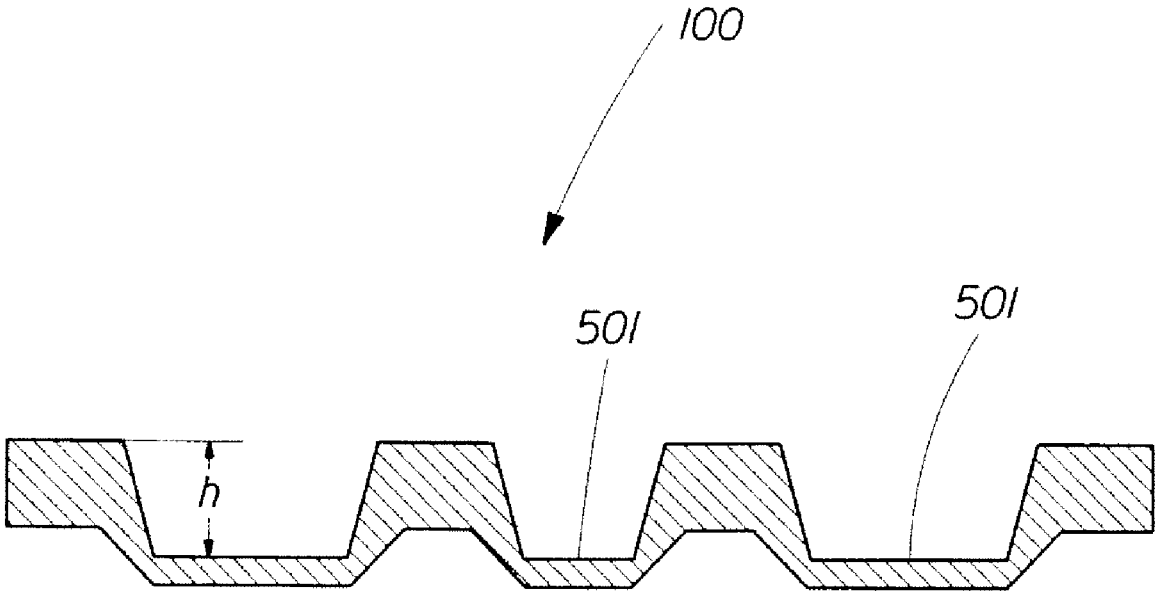
FIG. 6B is a cross-sectional view of the fibrous structure product of FIG. 5B taken along line 6B-6B.
Figure 6C:
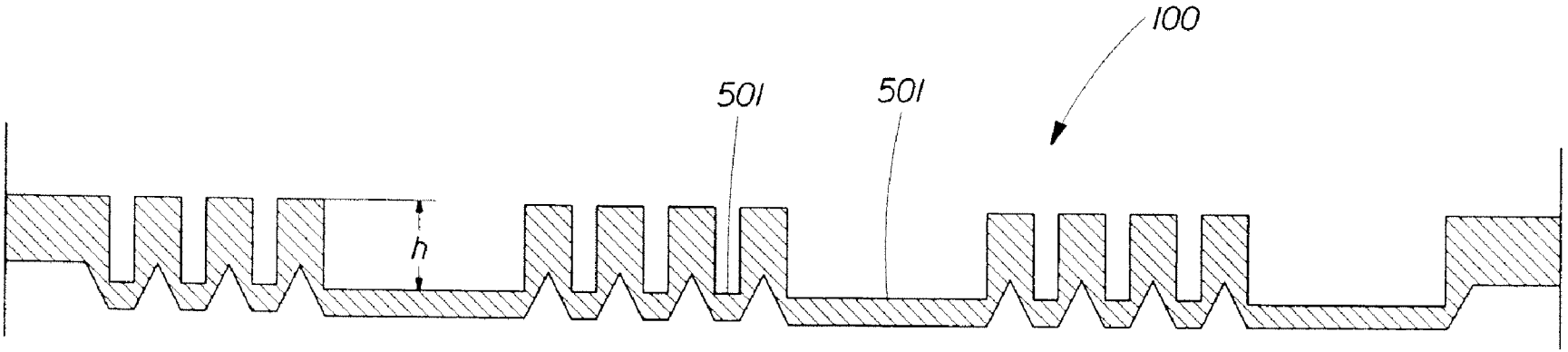
FIG. 6C is a cross-sectional view of the fibrous structure product of FIG. 5C taken along line 6C-6C.
Figure 6D:
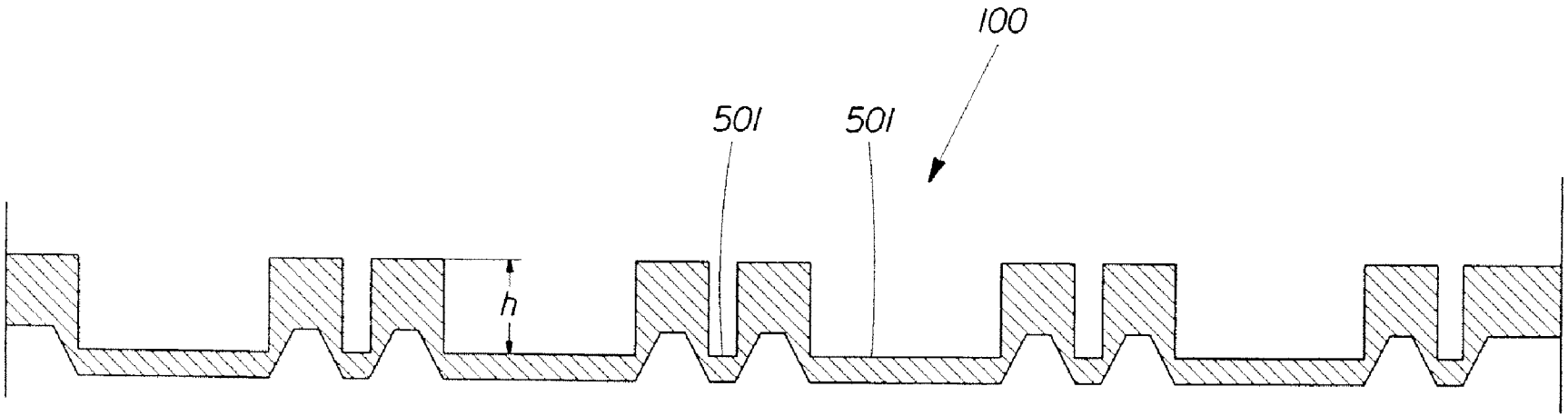
FIG. 6D is a cross-sectional view of the fibrous structure product of FIG. 5D taken along line 6D-6D.

In one embodiment, the features 501 that comprise the background pattern 503 comprise a major axis $A_{maj}$ and a minor axis $A_{min}$. The major axis may be described as follows: A rectangle is drawn (in the plane formed by the MD and CD) around the feature 501 such that a single side of the rectangle is tangent to the feature 501 (i.e., intercepts no more than one point on the feature 501). A line that is parallel to, or collinear with, the longest side of the rectangle is the major axis $A_{maj}$. The minor axis is a line that is perpendicular to, and coplanar with, the major axis. FIGS. 5B-5D further comprise a base pattern 502 as described supra. In embodiments wherein a single feature 501 is repeated to form the background pattern 503, the single feature 501 may be thought of as the base pattern.

FIGS. 6A-6D are cross sectional views of the fibrous structure product 100 described in FIGS. 5A-5D taken along lines 5A-5A, 5B-5B, 5C-5C, and 5D-5D, respectively. The features 501 have a height h that extends in the Z-direction of the surface of the cellulosic fibrous structure product 100. In one embodiment, the cellulosic fibrous structure product 100 comprises a feature height h of from about 200 μm to about 1000 μm. The height of the features 501 may be measured using the Embossment Height Measurement Method described infra.

Phasing of a Background and Master Pattern

Physically phasing a background pattern to a master (i.e., emboss) pattern may present significant technical and cost barriers. For example, the belt that is used to provide the background pattern must have the same pattern repeat frequency as the pattern repeat frequency as the master pattern (i.e., emboss) roll. One of skill in the art may appreciate that these frequencies are dependent on not only the desired pattern, but many process and equipment constraints as well. Nonlimiting exemplary constraints include roll design and run length.

Further, even with appropriately planned repeat frequencies, a high speed control system is likely required. Such a system may include a vision system with high enough scan rates to control at manufacturing speeds. However, one of skill in the art will appreciate that such a system may be susceptible to dust and other inevitabilities of any papermaking process. Thus, such a system is likely to be inefficient for maintaining proper control.

Additionally, a tension control device is likely required to adjust the relative length of paper because the stretch properties of paper are not constant. The varied stretch properties of paper would make it very difficult to register the background pattern to the master pattern consistently.

The paper product of the present invention utilizes optimized relative repeat frequency such that phasing of the background pattern and master pattern is not required. Surprisingly, the paper product of the present invention provides a "framed" background pattern (i.e., having the appearance of having an optimal phasing) without actually having to phase the background and master patterns.

Combined Pattern: Present Invention

Figure 7A:
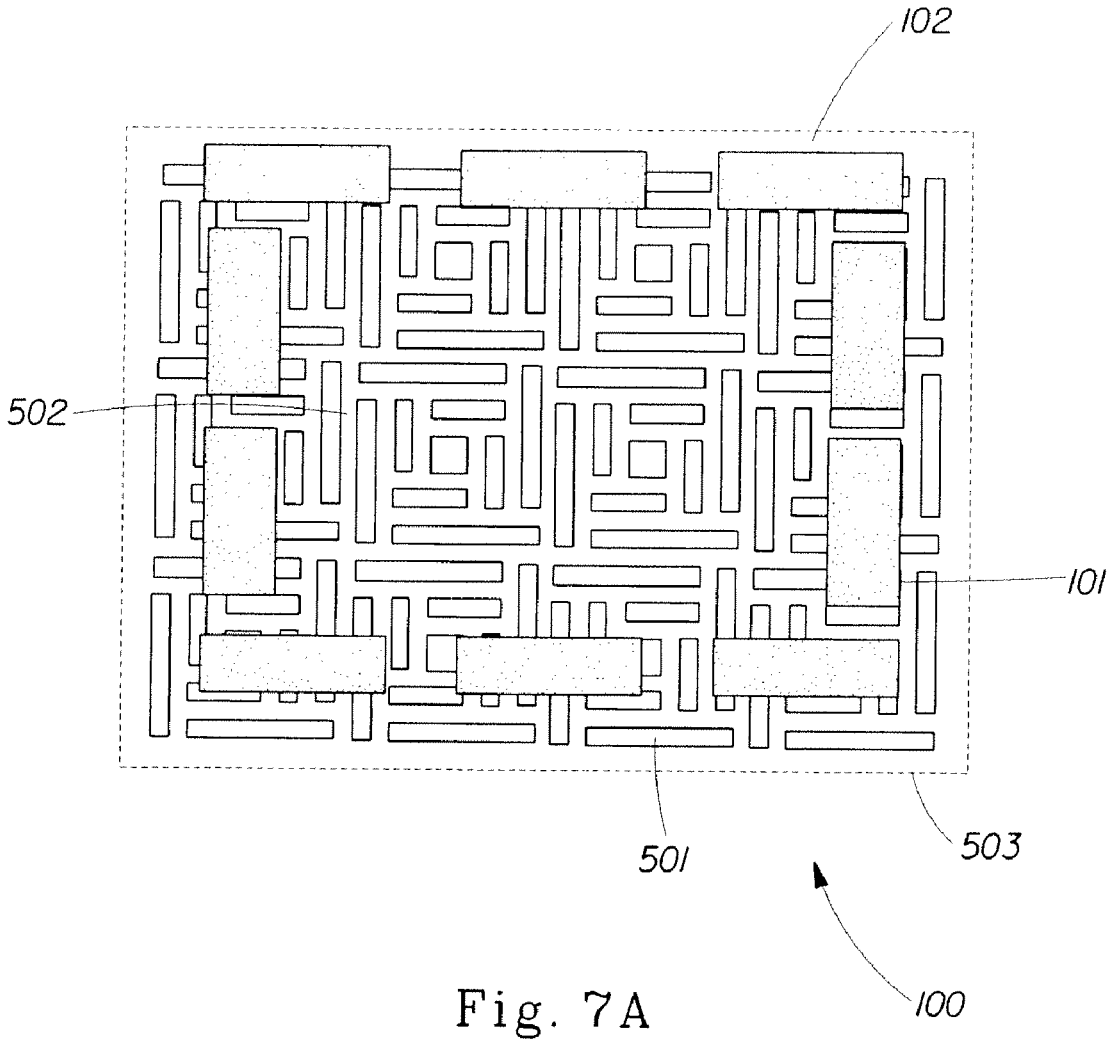
FIG. 7A is a top view of an exemplary embodiment of an optimized pattern according to the present invention.
Figure 7B:
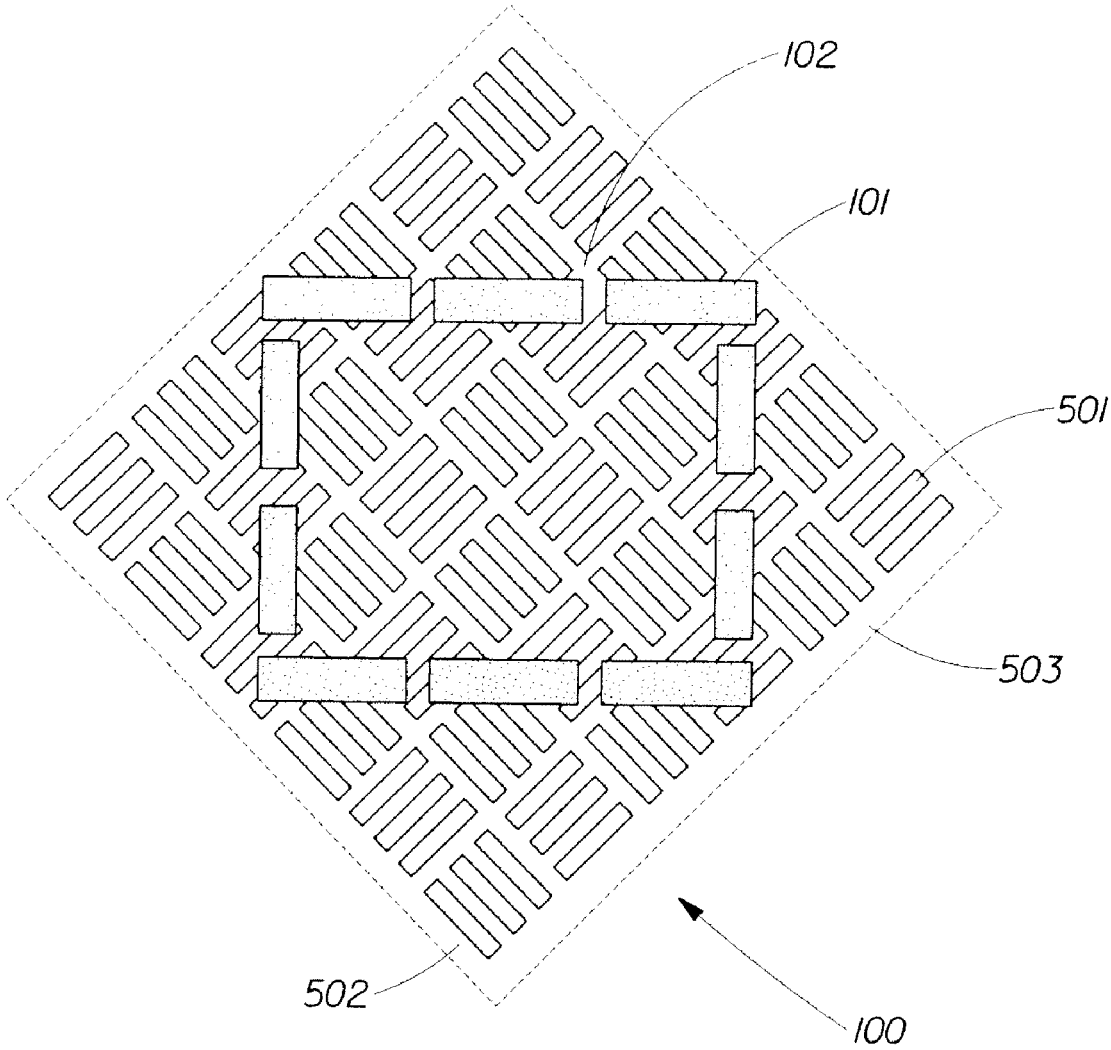
FIG. 7B is a top view of an exemplary embodiment of an optimized pattern according to the present invention.

FIGS. 7A-7B show exemplary embodiments of an optimized surface pattern for a fibrous structure product of the present invention. In the exemplary embodiments, the fibrous structure product 100 comprises, inter alia, embossments 101, features 501, master pattern 102, and background pattern 503 as described supra. In some embodiments described supra, the fibrous structure product comprises a base pattern 502.

A master pattern 102 may be repeated with any frequency and/or spacing that may be appropriate for the repeating pattern that is being used. Similarly, features 501 and, in some embodiments, features which form base patterns 502 may also be repeated with any frequency and/or spacing that may be appropriate for the background pattern 503 that is being used. In one embodiment, the frequency by which a base pattern is repeated within a certain area is greater than, or equal to, about 1.5 times the frequency by which a master pattern is repeated within the same area. In another embodiment, the frequency by which a base pattern is repeated within a certain area is from about 1.5 times to about 5 times the frequency by which a master pattern is repeated within the same area. In another embodiment still, the frequency by which a base pattern is repeated within a certain area is from about 1.5 times to about 3 times the frequency by which a master pattern is repeated within the same area. Without wishing to be limited by theory, it is thought that to avoid interference between the primary repeat pattern and the background pattern, there must be a large enough interval between the two patterns in order for the observer to be able to visually distinguish between the patterns. Further, it was surprisingly discovered that when a fibrous structure product is provided with a master pattern and background pattern having repeating frequencies as described supra, the master pattern provided a relatively optimal framing effect on the features of the background pattern.

In another embodiment, the major axis of at least one feature in a background pattern is parallel with at least one line segment axis of a master pattern wherein the at least one feature is positioned within the area occupied by the master pattern. In yet another embodiment, the major axis of at least one feature in a background pattern is perpendicular with at least one line segment axis of a master pattern wherein the at least one feature is positioned within the area occupied by the master pattern.

One of skill in the art may appreciate that the elements or embossments of a repeating pattern may be any shape which may be suitable for the desired application. Similarly, one of skill in the art may appreciate that the features of a base pattern or of a background pattern may be any shape which may be suitable for the desired application. In one embodiment, at least one element or embossment of a master pattern is the same shape as at least one feature of a background pattern. In a different embodiment, at least one element or embossment of a master pattern has the same aspect ratio as at least one feature of a background pattern. In another embodiment, at least one element or embossment of a master pattern has the same number of sides as at least one feature of a background pattern. In another embodiment, a master pattern has the same shape as a base pattern.

Without wishing to be limited by theory, it is thought that the pattern is optimized when the collinear and/or parallel nature of the elements of the repeating pattern frame the features of the background pattern. It is thought that the unique geometric combination allows the human eye to very easily distinguish the repeating pattern from the background pattern, thus causing the resultant pattern to have an increased quilted appearance. This can be distinguished from prior art paper towel products, particular prior art paper towel products that provide interference patterns (i.e., the emboss pattern and background patterns interfere with each other) between background and emboss (repeating) patterns. An example of a paper towel product having background and repeating patterns that are selected to interfere with each other is described in U.S. Pat. No. 7,169,458.

Extra Quilted Appearance

Figure 8:
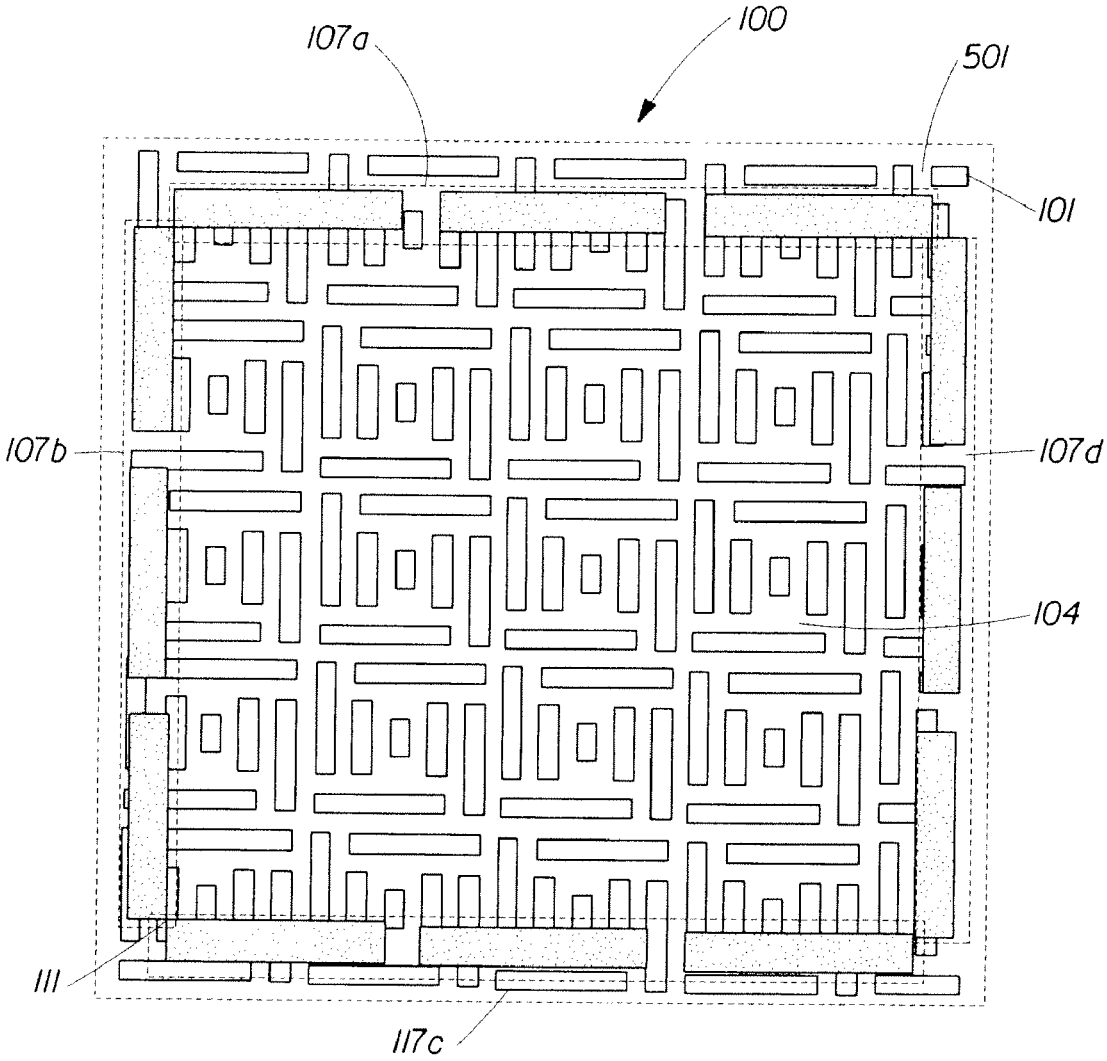
FIG. 8 is a top view of an exemplary embodiment of an optimized pattern according to the present invention.

Surprisingly it was discovered that the combined patterns of some embodiments of the present invention provide an especially cushion-like quilted appearance. For example, as shown in FIG. 8, in one embodiment the product 100 comprises a master pattern 101 and a background pattern 501 wherein the aspect ratio of the embossments is about 4 and wherein the frequency by which a base pattern is repeated within a certain area is greater than, or equal to, 1.5 times the frequency by which a master pattern is repeated within the same area. The exemplary master pattern 101 comprises a first line axis pattern 107*a* and a second line axis pattern 107*b* wherein the first and second line axes patterns 107*a*, 107*b* form an angle of about 90°. The first 107*a* and second 107*b* line axis patterns intersect third 107*c* and fourth 107*d* line axis patterns at corners 111 as shown in FIG. 8. As described supra, in the exemplary embodiment intersecting line axis patterns form angles of about 90°. In other embodiments of the invention, intersecting line axis patterns may form angles of from about 75° to about 105°.

Particular embodiments of the present invention comprising the exemplary combined pattern had a visually noticeable, and physically quantifiable, improvement in quilted appearance. Without wishing to be limited by theory, it is thought that the framing effect described supra is especially exaggerated when the master pattern 101 is aligned as exemplified (i.e., such that embossments on a first 107*a* and second 107*b* line axis pattern which form the 'corner' 111 of the master pattern 101 touch or come to a point) causes extra tension in the paper web and leads to an accumulation of web material in the cell 104 at the corners which allows for a relatively dramatic change in relative height (position in the z-direction) difference between the area in the cell and the surrounding embossments.

Paper Product

The present invention is equally applicable to all types of consumer paper products such as paper towels, toilet tissue, facial tissue, napkins, and the like.

The present invention contemplates the use of a variety of paper making fibers, such as, natural fibers, synthetic fibers, as well as any other suitable fibers, starches, and combinations thereof. Paper making fibers useful in the present invention include cellulosic fibers commonly known as wood pulp fibers. Applicable wood pulps include chemical pulps, such as Kraft, sulfite and sulfate pulps, as well as mechanical pulps including, groundwood, thermomechanical pulp, chemically modified, and the like. Chemical pulps may be used in tissue towel embodiments since they are known to those of skill in the art to impart a superior tactical sense of softness to tissue sheets made therefrom. Pulps derived from deciduous trees (hardwood) and/or coniferous trees (softwood) can be utilized herein. Such hardwood and softwood fibers can be blended or deposited in layers to provide a stratified web. Exemplary layering embodiments and processes of layering are disclosed in U.S. Pat. Nos. 3,994,771 and 4,300,981. Additionally, fibers derived from wood pulp such as cotton linters, bagesse, and the like, can be used. Additionally, fibers derived from recycled paper, which may contain any of all of the categories as well as other non-fibrous materials such as fillers and adhesives used to manufacture the original paper product may be used in the present web. In addition, fibers and/or filaments made from polymers, specifically hydroxyl polymers, may be used in the present invention. Non-limiting examples of suitable hydroxyl polymers include polyvinyl alcohol, starch, starch derivatives, chitosan, chitosan derivatives, cellulose derivatives, gums, arabinans, galactans, and combinations thereof. Additionally, other synthetic fibers such as rayon, polyethylene, and polypropylene fibers can be used within the scope of the present invention. Further, such fibers may be latex bonded.

In one embodiment the paper is produced by forming a predominantly aqueous slurry comprising about 95% to about 99.9% water. In one embodiment the non-aqueous component of the slurry used to make the fibrous structure comprises from about 5% to about 80% of eucalyptus fibers by weight. In another embodiment the non-aqueous components comprises from about 8% to about 60% of eucalyptus fibers by weight, and in yet another embodiment from about 12% to about 40% of eucalyptus fibers by weight of the non-aqueous component of the slurry. The aqueous slurry can be pumped to the headbox of the papermaking process.

In one embodiment the present invention may comprise a co-formed fibrous structure. A co-formed fibrous structure comprises a mixture of at least two different materials wherein at least one of the materials comprises a non-naturally occurring fiber, such as a polypropylene fiber, and at least one other material, different from the first material, comprising a solid additive, such as another fiber and/or a particulate. In one example, a co-formed fibrous structure comprises solid additives, such as naturally occurring fibers, such as wood pulp fibers, and non-naturally occurring fibers, such as polypropylene fibers.

Synthetic fibers useful herein include any material, such as, but not limited to polymers, such as those selected from the group consisting of polyesters, polypropylenes, polyethylenes, polyethers, polyamides, polyhydroxyalkanoates, polysaccharides, and combinations thereof. More specifically, the material of the polymer segment may be selected from the group consisting of poly(ethylene terephthalate), poly(butylene terephthalate), poly(1,4-cyclohexylenedimethylene terephthalate), isophthalic acid copolymers (e.g., terephthalate cyclohexylene-dimethylene isophthalate copolymer), ethylene glycol copolymers (e.g., ethylene terephthalate cyclohexylene-dimethylene copolymer), polycaprolactone, poly(hydroxyl ether ester), poly(hydroxyl ether amide), polyesteramide, poly(lactic acid), polyhydroxybutyrate, and combinations thereof.

Further, the synthetic fibers can be a single component (i.e., single synthetic material or a mixture to make up the entire fiber), bi-component (i.e., the fiber is divided into regions, the regions including two or more different synthetic materials or mixtures thereof and may include co-extruded fibers) and combinations thereof. It is also possible to use bicomponent fibers, or simply bicomponent or sheath polymers. Nonlimiting examples of suitable bicomponent fibers are fibers made of copolymers of polyester (polyethylene terephthalate)/polyester (polyethylene terephthalate) otherwise known as "CoPET/PET" fibers, which are commercially available from Fiber Innovation Technology, Inc., Johnson City, Tenn.

These bicomponent fibers can be used as a component fiber of the structure, and/or they may be present to act as a binder for the other fibers present. Any or all of the synthetic fibers may be treated before, during, or after the process of the present invention to change any desired properties of the fibers. For example, in certain embodiments, it may be desirable to treat the synthetic fibers before or during the papermaking process to make them more hydrophilic, more wettable, etc.

These multicomponent and/or synthetic fibers are further described in U.S. Pat. Nos. 6,746,766, 6,946,506, and 6,890,872; and U.S. Pat. Pub. Nos. 2003/0077444A1, 2003/0168912A1, 2003/0092343A1, 2002/0168518A1, 2005/0079785A1, 2005/0026529A1, 2004/0154768A1, 2004/0154767, 2004/0154769A1, 2004/0157524A1, and 2005/0201965A1.

The fibrous structure may comprise any tissue-towel paper product known in the industry. Embodiment of these substrates may be made according U.S. Pat. Nos. 4,191,4,300, 4,191,609, 4,514,345, 4,528,239, 4,529,480, 4,637,859, 5,245,025, 5,275,700, 5,328,565, 5,334,289, 5,364,504, 5,527,428, 5,556,509, 5,628,876, 5,629,052, 5,637,194, and 5,411,636; EP 677612; and U.S. Pat. Pub. No. 2004/0192136A1.

The tissue-towel substrates may be manufactured via a wet-laid making process where the resulting web is through-air-dried or conventionally dried. Optionally, the substrate may be foreshortened by creping or by wet microcontraction. Creping and/or wet microcontraction are disclosed in commonly assigned U.S. Pat. Nos. 6,048,938, 5,942,085, 5,865,950, 4,440,597, 4,191,756, and 6,187,138.

Conventionally pressed tissue paper and methods for making such paper are known in the art, for example U.S. Pat. No. 6,547,928. One suitable tissue paper is pattern densified tissue paper which is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. Processes for making pattern densified tissue webs are disclosed in U.S. Pat. Nos. 3,301,746, 3,974,025, 4,191,609, 4,637,859, 3,301,746, 3,821,068, 3,974,025, 3,573,164, 3,473,576, 4,239,065, and 4,528,239.

Uncompacted, non pattern-densified tissue paper structures are also contemplated within the scope of the present invention and are described in U.S. Pat. Nos. 3,812,000, 4,208,459, and 5,656,132. Uncreped tissue paper as defined in the art are also contemplated. The techniques to produce uncreped tissue in this manner are taught in the prior art. For example, Wendt, et al. in European Patent Application Nos. 0 677 612A2 and 0 617 164 A1.

Uncreped tissue paper, in one embodiment, refers to tissue paper which is non-compressively dried, by through air drying. Resultant through air dried webs are pattern densified such that zones of relatively high density are dispersed within a high bulk field, including pattern densified tissue wherein zones of relatively high density are continuous and the high bulk field is discrete. The techniques to produce uncreped tissue in this manner are taught in the prior art. For example, European Patent Application Nos. 0 677 612A2 and 0 617 164 A1; and U.S. Pat. No. 5,656,132.

Other materials are also intended to be within the scope of the present invention as long as they do not interfere or counteract any advantage presented by the instant invention.

The substrate which comprises the fibrous structure of the present invention may be cellulosic, non-cellulosic, or a combination of both. The substrate may be conventionally dried using one or more press felts or through-air dried. If the substrate which comprises the paper according to the present invention is conventionally dried, it may be conventionally dried using a felt which applies a pattern to the paper as taught in U.S. Pat. No. 5,556,509 and PCT App. No. WO 96/00812. The substrate which comprises the paper according to the present invention may also be through air dried. A suitable through air dried substrate may be made according to U.S. Pat. No. 4,191,609.

In one embodiment, the fibrous structure product has a basis weight of about 15 lbs/3000 $ft^2$ to about 50 lbs/3000 $ft^2$. In another embodiment the basis weight is about 27 lbs/3000 $ft^2$ to about 40 lbs/3000 $ft^2$; in another embodiment the basis weight is about 30 lbs/3000 $ft^2$ and about 40 lbs/3000 $ft^2$, and in another embodiment the basis weight is about 32 lbs/3000 $ft^2$ and about 37 lbs/3000 $ft^2$.

Test Methods

The following describe the test methods utilized by the instant application in order to determine the values consistent with those presented herein.

Embossment Height Measurement Method

The geometric characteristics of the embossment structure of the present invention are measured using an Optical 3D Measuring System MikroCAD compact for paper measurement instrument (the "GFM MikroCAD optical profiler instrument") and ODSCAD Version 4.14 software available from GFMesstechnik GmbH, Warthestraβe E21, D14513 Teltow, Berlin, Germany. The GFM MikroCAD optical profiler instrument includes a compact optical measuring sensor based on digital micro-mirror projection, consisting of the following components:

A) A DMD projector with 1024×768 direct digital controlled micro-mirrors.
B) CCD camera with high resolution (1280×1024 pixels).
C) Projection optics adapted to a measuring area of at least 160×120 mm.
D) Recording optics adapted to a measuring area of at least 160×120 mm;
E) Schott KL1500 LCD cold light source.
F) A table stand consisting of a motorized telescoping mounting pillar and a hard stone plate;
G) Measuring, control and evaluation computer.
H) Measuring, control and evaluation software ODSCAD 4.14.
I) Adjusting probes for lateral (XY) and vertical (Z) calibration.

The GFM MikroCAD optical profiler system measures the height of a sample using the digital micro-mirror pattern projection technique. The result of the analysis is a map of surface height (Z) versus XY displacement. The system should provide a field of view of 160×120 mm with an XY resolution of 21 μm. The height resolution is set to between 0.10 μm and 1.00 μm. The height range is 64,000 times the resolution. To measure a fibrous structure sample, the following steps are utilized:

1. Turn on the cold-light source. The settings on the cold-light source are set to provide a reading of at least 2,800 k on the display.
2. Turn on the computer, monitor, and printer, and open the software.
3. Verify calibration accuracy by following the manufacturer's instructions.
4. Select "Start Measurement" icon from the ODSCAD task bar and then click the "Live Image" button.
5. Obtain a fibrous structure sample that is larger than the equipment field of view and conditioned at a temperature of 73° F.±2° F. (about 23° C.±1° C.) and a relative humidity of 50%±2% for 2 hours. Place the sample under the projection head. Position the projection head to be normal to the sample surface.
6. Adjust the distance between the sample and the projection head for best focus in the following manner. Turn on the "Show Cross" button. A blue cross should appear on the screen. Click the "Pattern" button repeatedly to project one of the several focusing patterns to aid in achieving the best focus. Select a pattern with a cross hair such as the one with the square. Adjust the focus control until the cross hair is aligned with the blue "cross" on the screen.
7. Adjust image brightness by increasing or decreasing the intensity of the cold light source or by altering the camera gains setting on the screen. When the illumination is optimum, the red circle at the bottom of the screen labeled "I.O." will turn green.
8. Select "Standard" measurement type.
9. Click on the "Measure" button. The sample should remain stationary during the data acquisition.
10. To move the data into the analysis portion of the software, click on the clipboard/man icon.
11. Click on the icon "Draw Cutting Lines." On the captured image, "draw" a cutting line that extends from the center of a negative embossment through the centers of at least six negative embossments, ending on the center of a final negative embossment. Click on the icon "Show Sectional Line Diagram." Move the cross-hairs to a representative low point on one of the left hand negative embossments and click the mouse. Then move the cross-hairs to a representative low point on one of the right hand negative embossments and click the mouse. Click on the "Align" button by marked point's icon. The Sectional Line Diagram is now adjusted to the zero reference line.
12. Measurement of Emboss Height, h. Using the Sectional Line Diagram described in step 11, click the mouse on a representative low point of a negative emboss, followed by clicking the mouse on a representative point on the nearby upper surface of the sample. Click the "Vertical" distance icon. Record the distance measurement. Repeat the previous steps until the depth of six negative embossments have been measured. Take the average of all recorded numbers and report in mm, or μm, as desired. This number is the embossment height.

EXAMPLE I

One fibrous structure useful in achieving the embossed paper product of the present invention is a through-air-dried (TAD), differential density structure. Such a structure may be formed by the following process.

A Fourdrinier, through-air-dried papermaking machine is run under the following conditions to produce fibrous structure products of the present invention. A wet-microcontracted fibrous structure product is produced herein, comprising the steps of: first forming an embryonic web from an aqueous fibrous papermaking furnish. A slurry of papermaking fibers is pumped to the headbox at a consistency of about 0.15%. The slurry or furnish of the web comprises sixty five percent (65%) northern softwood kraft (NSK) (i.e., long papermaking fibers) and thirty five percent (35%) chemi-thermal mechanical pulp. A strength additive, Kymene 557H, is added to the furnish at a rate of about 20 pounds per ton (about 10 gms/kg). Kymene is a registered trademark of Hercules Inc, of Wilmington, Del. The web is then forwarded at a first velocity, $V_1$, on a carrier fabric to a transfer zone having a transfer/imprinting fabric. The water is partially removed from the wet web, by non-compressively removing water from the web to a fiber consistency of from about 10% to about 30%, immediately prior to reaching the transfer zone to enable the web to be transferred to the transfer/imprinting fabric at the transfer zone. Dewatering occurs through the Fourdrinier wire and is assisted by vacuum boxes. The wire is of a configuration having 41.7 machine direction and 42.5 cross direction filaments per cm, available from Asten Johnson known as a "786 wire".

The web is then transferred to the transfer/imprinting fabric in the transfer zone without precipitating substantial densification of the web. The web is then forwarded, at a second velocity, $V_2$, on the transfer/imprinting fabric along a looped path in contacting relation with a transfer head disposed at the transfer zone, the second velocity being from about 5% to about 40% slower than the first velocity. Since the wire speed is faster than the transfer/imprinting fabric, wet shortening of the web occurs at the transfer point. Thus, the wet web foreshortening may be about 3% to about 15%.

The transfer/imprinting fabric comprises a framework comprises a photosensitive resin, and a reinforcing element that is a fluid-permeable, woven fabric. The sheet side of the transfer/imprinting fabric consists of a continuous, patterned network of photopolymer resin, the pattern contains about 20 features/in$^2$. The polymer network covers about 25% of the surface area of the transfer/imprinting fabric. The polymer resin is supported by and attached to a woven reinforcing element having of 27.6 machine direction and 11.8 cross direction filaments per cm. The photopolymer network rises about 0.43 mm above the reinforcing element.

The web is then adhesively secured to a drying cylinder having a third velocity, $V_3$. Polyvinyl alcohol creping adhesive is used. The drying cylinder is operated at a range of about 145° C. to about 170° C. or about 157° C., and the dryer, Yankee hoods, are operated at about 120° C. The web is then dried on the drying cylinder without overall mechanical compaction of the web. The web is then creped from the drying cylinder with a doctor blade, the doctor blade having an impact angle of from about 90 degrees to about 130 degrees. Thereafter the dried web is reeled at a fourth velocity, $V_4$, that is faster than the third velocity, $V_3$, of the drying cylinder.

The paper is then subjected to a knob-to-rubber impression embossing process as follows. An emboss roll is engraved with a nonrandom pattern of protrusions. The emboss roll is mounted, along with a backside impression roll, in an apparatus with their respective axes being generally parallel to one another. The emboss roll comprises embossing protrusions which are frustoconical in shape, with a face (top or distal—i.e. away from the roll from which they protrude) diameter of about 2.79 mm and a floor (bottom or proximal—i.e. closest to the surface of the roll from which they protrude) diameter of about 4.12 mm. The height of the embossing protrusions on the emboss roll is about 2.845 mm. The radius of curvature of the transition region of the embossing protrusions is about 0.76 mm. The planar projected area of each embossing single pattern unit is about 25 cm$^2$. The nonrandom pattern of emboss protrusions comprises approximately 10% emboss contact area. The backside impression roll is made of Valcoat™ material from Valley Roller Company, Mansfield, Tex. and has a P&J softness value of 125. The impression roll is set to deliver a nip length of about 2 inches (5 cm) by applying a pressure of approximately 140 pounds per linear inch (pli) of roller. The 140 pli applied to a 2 inch nip width on an emboss pattern with 10% contact area results in a pressure at the emboss knobs of from about 600 pounds per square inch to about 800 pounds per square inch of emboss contact area. The paper web is passed through the nip at a speed of 1000 feet per minute.

The resulting paper has an embossment height of about 800 μm, wherein each embossment has an aspect ratio of about 3.0. Embossments within a line axis pattern are aligned to be collinear and the frequency by which the base pattern is repeated within a certain area is about 5 times the frequency by which a master pattern is repeated within the same area.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A ply of fibrous structure product, comprising:

a background pattern; and a repeating pattern disposed on a portion of the background pattern, wherein the repeating pattern comprises a master pattern comprising:

a first individual embossment comprising a major axis and a minor axis;

a first line segment axis parallel to the major axis of the first individual embossment; and at least one individual embossment adjacent to the first individual embossment, wherein the individual embossment adjacent to the first individual embossment comprises a major axis and a minor axis, wherein the major axis of the individual embossment adjacent to the first individual embossment and the first line segment axis form an angle of from about 0.5° to about 20°.

2. The ply of fibrous structure product of claim 1, comprising a second individual embossment comprising a major axis and a minor axis.

3. The ply of fibrous structure product of claim 2, comprising a second line segment axis parallel to the major axis of the second individual embossment.

4. The ply of fibrous structure product of claim 3, comprising at least one individual embossment adjacent to the second individual embossment, wherein the individual embossment adjacent to the second individual embossment comprises a major axis and a minor axis, and wherein the major axis of the individual embossment adjacent to the second individual embossment and the second line segment axis form an angle of from about 0.5° to about 20°.

5. The ply of fibrous structure product of claim 4, wherein the individual embossment adjacent to the first individual embossment is positioned on the first line segment axis to form a first line axis pattern and the individual embossment adjacent to the second individual embossment is positioned on the second line segment axis to form a second line axis pattern.

6. The ply of fibrous structure product of claim 5, wherein the first line segment axis pattern and the second line segment axis pattern intersect to form an angle of about 90°.

7. The ply of fibrous structure product of claim 2, wherein the first individual embossment and the second individual embossment together come to a point to form a corner.

8. The ply of fibrous structure product of claim 1, wherein the major axis of the individual embossment adjacent to the first individual embossment and the first line segment axis form an angle of from about 0.5° to about 10°.

9. The ply of fibrous structure product of claim 1, wherein the major axis of the individual embossment adjacent to the first individual embossment and the first line segment axis form an angle of from about 2.0° to about 5.0°.

10. The ply of fibrous structure product of claim 1, wherein the background pattern comprises one or more features comprising a base pattern, and wherein the frequency by which the base pattern is repeated within an area is from about 1.5 times to about 3 times by which the master pattern is repeated within the area.

11. A ply of fibrous structure product, comprising:

a background pattern comprising one or more features comprising a base pattern; and a repeating pattern positioned over a portion of the background pattern, wherein the repeating pattern comprises a master pattern comprising:

a first individual embossment comprising a major axis and a minor axis;

a first line segment axis parallel to the major axis of the first individual embossment;

at least one individual embossment adjacent to the first individual embossment, wherein the at least one individual embossment is positioned on the first line segment axis to form a first line axis pattern;

a second individual embossment comprising a major axis and a minor axis, wherein the first individual embossment and the second individual embossment touch each other to form a corner;

a second line segment axis parallel to the major axis of the second individual embossment; and at least one individual embossment adjacent to the second individual embossment, wherein the at least one individual embossment adjacent to the second individual embossment is positioned on the second line segment axis to form a second line axis pattern;

wherein the frequency by which the base pattern is repeated within an area is from about 1.5 times to about 3 times by which the master pattern is repeated within the area.

12. The ply of fibrous structure product of claim 11, wherein the individual embossment adjacent to the first individual embossment comprises a major axis and a minor axis, and wherein the major axis of the individual embossment adjacent to the first individual embossment and the first line segment axis form an angle of from about 0.5° to about 10°.

13. The ply of fibrous structure product of claim 11, wherein the individual embossment adjacent to the second individual embossment comprises a major axis and a minor axis, and wherein the major axis of the individual embossment adjacent to the second individual embossment and the second line segment axis form an angle of from about 0.5° to about 10°.

14. The ply of fibrous structure product of claim 11, wherein the first line segment axis pattern and the second line segment axis pattern intersect to form an angle of about 90°.

15. A ply of fibrous structure product, comprising:

a background pattern comprising:

a first feature having a major axis extending in a first direction; and a second feature having a major axis extending in a second direction; and a repeating pattern disposed over a portion of the background pattern, wherein the repeating pattern comprises a master pattern comprising:

a first individual embossment comprising a major axis and a minor axis, wherein the major axis of the first individual embossment extends in a third direction;

at least one individual embossment adjacent to the first individual embossment;

a second individual embossment comprising a major axis and a minor axis, wherein the major axis of the second individual embossment extends in a fourth direction; and at least one individual embossment adjacent to the second individual embossment, wherein the first direction, the second direction, the third direction, and the fourth direction are all different directions.

16. The ply of fibrous structure product of claim 15, comprising a first line segment axis parallel to the major axis of the first individual embossment, wherein the individual embossment adjacent to the first individual embossment comprises a major axis and a minor axis, and wherein the major axis of the individual embossment adjacent to the first individual embossment and the first line segment axis form an angle of from about 0.5° to about 10°.

17. The ply of fibrous structure product of claim 15, comprising a second line segment axis parallel to the major axis of the second individual embossment, wherein the individual embossment adjacent to the second individual embossment comprises a major axis and a minor axis, and wherein the major axis of the individual embossment adjacent to the second individual embossment and the second line segment axis form an angle of from about 0.5° to about 10°.

18. The ply of fibrous structure product of claim 15, wherein the background pattern comprises one or more features comprising a base pattern, and wherein the frequency by which the base pattern is repeated within an area is from about 1.5 times to about 3 times by which the master pattern is repeated within the area.

19. The ply of fibrous structure product of claim 15, comprising a first line segment axis parallel to the major axis of the first individual embossment and a second line segment axis parallel to the major axis of the second individual embossment, wherein the first individual embossment is positioned on the first line segment axis to form a first line axis pattern and the second individual embossment is positioned on the second line segment axis to form a second line axis pattern.

20. The ply of fibrous structure product of claim 19, wherein the first line segment axis pattern and the second line segment axis pattern intersect to form a corner.

* * * * *